US010786038B2

(12) United States Patent
Berend et al.

(10) Patent No.: US 10,786,038 B2
(45) **Date of Patent: *Sep. 29, 2020**

(54) CLEATED FOOTWEAR

(71) Applicant: NIKE, Inc., Beaverton, OR (US)

(72) Inventors: Thomas Berend, Beaverton, OR (US); Paul J. Francis, Portland, OR (US); Shane S. Kohatsu, Portland, OR (US); Ryan R. Larson, Portland, OR (US); Dov Michael Lashmore, Milwaukie, OR (US); Troy C. Lindner, Portland, OR (US); Kenneth Link, Portland, OR (US); Randall S. Wolfe, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 151 days.

This patent is subject to a terminal disclaimer.

(21) Appl. No.: 16/036,313

(22) Filed: Jul. 16, 2018

(65) Prior Publication Data

US 2018/0325213 A1 Nov. 15, 2018

Related U.S. Application Data

(63) Continuation of application No. 15/211,268, filed on Jul. 15, 2016, now Pat. No. 10,045,588, which is a (Continued)

(51) Int. Cl.
*A43C 15/16* (2006.01)
*A43B 13/14* (2006.01)

(Continued)

(52) U.S. Cl.
CPC ..... *A43B 13/141* (2013.01); *A43B 5/02* (2013.01); *A43B 13/14* (2013.01); *A43B 13/223* (2013.01);

(Continued)

(58) Field of Classification Search
CPC .. A43B 5/00; A43B 5/02; A43B 13/00; A43B 23/22; A43B 23/222; A43B 23/227; A43C 15/16
See application file for complete search history.

(56) References Cited

U.S. PATENT DOCUMENTS 2,509,980 A * 5/1950 McCallum ..... A43C 15/161 36/62
3,352,034 A 11/1967 Braun (Continued)

FOREIGN PATENT DOCUMENTS

AU 8665282 A 2/1983
CN 102271547 A 12/2011

(Continued)

OTHER PUBLICATIONS

"Get Faster for Football: Nike Unveils New 3D Printed Super Bowl Cleat," retrieved from www.3ders.org, published Jan. 12, 2014, 11 pages.

(Continued)

*Primary Examiner* — Marie D Bays
(74) *Attorney, Agent, or Firm* — Banner & Witcoff, Ltd.

(57) ABSTRACT

Sole structures for articles of footwear (e.g., outsole components) have one or more of: a base plate having a V-shaped support structure with lateral and medial support members extending forward from a base support area located in a heel or rear midfoot area of the outsole component; a base plate having a matrix structure with recesses or openings formed between rib elements that make up the matrix structure; and/or a base plate having a rear heel support. The base plates may be made, at least in part, as unitary, one-piece constructions, using selective laser sintering or other three-dimensional printing and/or rapid manufacturing additive fabrication techniques.

20 Claims, 16 Drawing Sheets

Related U.S. Application Data continuation of application No. 14/159,078, filed on Jan. 20, 2014, now Pat. No. 9,414,642.

(60) Provisional application No. 61/755,215, filed on Jan. 22, 2013.

(51) Int. Cl.

| | |
|---|---|
| ***A43C 13/04*** | (2006.01) |
| ***A43B 23/22*** | (2006.01) |
| ***A43B 5/02*** | (2006.01) |
| ***A43B 13/22*** | (2006.01) |
| ***A43C 15/02*** | (2006.01) |

(52) U.S. Cl.

CPC ..... *A43B 23/22* (2013.01); *A43C 13/04* (2013.01); *A43C 15/02* (2013.01); *A43C 15/16* (2013.01); *A43C 15/162* (2013.01); *A43C 15/168* (2013.01); *A43D 2200/60* (2013.01)

(56) References Cited

U.S. PATENT DOCUMENTS

| | | | | |
|---|---|---|---|---|
| 3,859,739 | A | 1/1975 | Dassler | |
| 4,364,188 | A * | 12/1982 | Turner | A43B 5/06 36/129 |
| 4,586,274 | A | 5/1986 | Blair | |
| D322,355 | S | 12/1991 | Arai | |
| 6,233,850 | B1 | 5/2001 | Peabody | |
| 6,421,933 | B1 | 7/2002 | Zamprogno | |
| 6,705,027 | B1 | 3/2004 | Campbell | |
| 6,810,605 | B2 | 11/2004 | Nakano et al. | |
| 6,904,707 | B2 | 6/2005 | McMullin | |
| 6,948,264 | B1 | 9/2005 | Lyden | |
| 6,973,745 | B2 | 12/2005 | Mills et al. | |
| 7,086,183 | B2 | 8/2006 | Wood et al. | |
| 7,263,788 | B2 | 9/2007 | Johnson | |
| 7,347,011 | B2 | 3/2008 | Dua et al. | |
| 7,941,945 | B2 | 5/2011 | Gerber | |
| 8,365,441 | B2 | 2/2013 | Kirby et al. | |
| D688,037 | S | 8/2013 | Dekovic et al. | |
| 8,720,086 | B2 | 5/2014 | Auger et al. | |
| 8,973,290 | B2 | 3/2015 | Howley et al. | |
| 9,044,064 | B2 * | 6/2015 | Baucom | A43B 13/122 |
| 9,119,438 | B2 | 9/2015 | Auger et al. | |
| 9,414,642 | B2 * | 8/2016 | Berend | A43B 13/141 |
| 9,445,645 | B2 | 9/2016 | Auger et al. | |
| 10,045,588 | B2 * | 8/2018 | Berend | A43B 23/22 |
| 2003/0093926 | A1 | 5/2003 | Auger et al. | |
| 2005/0016029 | A1 | 1/2005 | Auger et al. | |
| 2006/0021259 | A1 * | 2/2006 | Wood | A43C 15/167 36/128 |
| 2008/0098624 | A1 | 5/2008 | Goldman | |
| 2008/0282579 | A1 | 11/2008 | Bobbett et al. | |
| 2009/0100716 | A1 * | 4/2009 | Gerber | A43B 5/02 36/114 |
| 2009/0235558 | A1 | 9/2009 | Auger et al. | |
| 2009/0307932 | A1 | 12/2009 | Kirby et al. | |
| 2010/0126044 | A1 | 5/2010 | Davis | |
| 2011/0078922 | A1 | 4/2011 | Cavaliere et al. | |
| 2011/0088285 | A1 | 4/2011 | Dojan et al. | |
| 2011/0088287 | A1 | 4/2011 | Auger et al. | |
| 2011/0197475 | A1 | 8/2011 | Weidl et al. | |
| 2012/0011744 | A1 | 1/2012 | Bell et al. | |
| 2012/0036740 | A1 | 2/2012 | Gerber | |
| 2012/0198720 | A1 | 8/2012 | Farris et al. | |
| 2012/0279091 | A1 | 11/2012 | Baucom et al. | |
| 2013/0055599 | A1 | 3/2013 | Peikert et al. | |
| 2013/0067778 | A1 | 3/2013 | Minami | |
| 2013/0125423 | A1 | 5/2013 | Droege et al. | |
| 2013/0139412 | A1 | 6/2013 | Auger et al. | |
| 2013/0160328 | A1 | 6/2013 | Hatfield et al. | |
| 2013/0185960 | A1 | 7/2013 | Schmid | |
| 2013/0333248 | A1 | 12/2013 | Auger et al. | |
| 2013/0340295 | A1 | 12/2013 | Adami et al. | |
| 2014/0026441 | A1 | 1/2014 | Stauffer | |
| 2014/0026444 | A1 | 1/2014 | Howley et al. | |
| 2015/0082669 | A1 | 3/2015 | Peikert et al. | |
| 2015/0181977 | A1 * | 7/2015 | Klug | A43C 15/162 36/134 |
| 2016/0219975 | A1 | 8/2016 | Wright | |
| 2016/0219979 | A1 | 8/2016 | Wright | |

FOREIGN PATENT DOCUMENTS

| | | | |
|---|---|---|---|
| JP | 2000236913 | A | 9/2000 |
| JP | 2006296761 | A | 11/2006 |
| JP | 2007275226 | A | 10/2007 |
| RU | 2050804 | C1 | 12/1995 |
| WO | 03045182 | A1 | 6/2003 |
| WO | 2006122832 | A2 | 11/2006 |

OTHER PUBLICATIONS

"Nike Debuts Third Football Cleat Built Using 3D Printing," retrieved from www.3ders.org, published Feb. 27, 2014, 11 pages.

"New Balance 3D Printing Innovation," retrieved from insidethesneakerbox.com, Ó2014 Inside the Sneakerbox, Inc., 7 pages.

Jul. 1, 2014—(WO) ISR & WO—App. No. PCT/US14/01272.

* cited by examiner

CLEATED FOOTWEAR

RELATED APPLICATION DATA

This application is a continuation of co-pending U.S. patent application Ser. No. 15/211,268, titled "Cleated Footwear" and filed Jul. 15, 2016, which application is a continuation of U.S. patent application Ser. No. 14/159,078, titled "Cleated Footwear" and filed Jan. 20, 2014 (now U.S. Pat. No. 9,414,642 B2), which application claims priority to U.S. Provisional Patent Application No. 61/755,215, titled "Cleated Footwear" and filed Jan. 22, 2013. Each of U.S. patent application Ser. No. 15/211,268, U.S. patent application Ser. No. 14/159,078, and U.S. Provisional Patent Application No. 61/755,215, in its entirety, is incorporated by reference herein.

FIELD OF THE INVENTION

The present invention relates to the field of footwear. More specifically, some aspects of the present invention pertain to cleat structures, sole structures including such cleat structures, and articles of footwear (e.g., athletic footwear) that include such sole structures. Additional aspects of this invention relate to methods of making footwear sole structures with these cleats.

BACKGROUND

Cleated footwear provides enhanced traction for athletes in various activities, such as baseball, football, soccer, golf, etc. The cleats on such footwear may have different sizes, shapes, orientations, and arrangements on a footwear sole structure, e.g., for use in different activities and/or under different field conditions.

Recent years have witnessed significant changes in artificial turfs and artificial grasses used in athletic fields for various sports. Aspects of the present invention relate to cleated footwear structures, e.g., for football shoes and/or other footwear structures, optionally for use on artificial grass and/or natural grass fields.

SUMMARY

This Summary is provided to introduce some general concepts relating to this invention in a simplified form that are further described below in the Detailed Description. This Summary is not intended to identify key features or essential features of the invention.

Some aspects of this invention relate to cleat structures, e.g., cleats for football shoes or other cleated footwear, e.g., for use on natural and/or artificial grass fields. Such cleat structures may include: (a) a cleat base; (b) a cleat free end; (c) a first side edge extending between the cleat base and the cleat free end, wherein the first side edge may have a first concave exterior surface over at least 50% of its height dimension (and in some examples, over at least 75% or even over at least 90% of its height dimension) between the cleat base and the cleat free end; and (d) at least second and third side edges extending between the cleat base and the cleat free end, wherein the second and third side edges may be flat or concave over at least 50% of their height dimensions (and in some examples, over at least 75% or even over at least 90% of their height dimensions) between the cleat base and the cleat free end. In some cleat structures, at least the central 50% (and in some examples, at least the central 75% or even at least the central 90%) of the first side edge of the cleat (with respect to a height dimension of the cleat) will have the concave exterior surface.

Additional aspects of this invention relate to footwear sole structures (e.g., outsole components) and/or articles of footwear that include one or more cleat structures, e.g., of the types described above. Such sole structures may include:

(a) one or more perimeter cleats located along a side of a forefoot area or a midfoot area of the outsole component (e.g., along the lateral side, the medial side, or both), wherein at least some of these perimeter cleats optionally include a concave rear edge that faces a rear heel direction of the sole structure, a three sided cleat structure, and/or the cleat structure described above;

(b) one or more cleats located in an intermediate forefoot area between the perimeter cleats, at a rear heel area, etc.;

(c) a base plate having a rear heel support portion, an arch support portion, and a forefoot support portion, wherein the base plate includes a V-shaped support structure having a lateral support member and a medial support member extending forward from a base support area located in a heel or rear midfoot area of the outsole component;

(d) a matrix structure formed in the base plate, the matrix structure optionally including: (i) a first plurality of rib elements extending in a first direction of the outsole component, (ii) a second plurality of rib elements extending in a second direction of the outsole component, (iii) a third plurality of rib elements extending in a third direction of the outsole component, (iv) a plurality of recesses between adjacent rib elements, and/or (v) a plurality of openings between adjacent rib elements;

(e) a rear heel support extending upward from the base plate at a rear heel area of the outsole component; and/or (f) a heel counter structure extending upward from the base plate at a heel area of the outsole component (for optionally supporting the lateral and medial sides of the heel as well as the rear heel).

Still additional aspects of this invention relate to methods of making such cleats and/or outsole structures, optionally as unitary, one-piece constructions, using selective laser sintering or other three-dimensional printing and/or rapid manufacturing additive fabrication techniques. Some example cleats and cleated sole structures and/or footwear structures in accordance with aspects of this invention relate to structures specifically designed to promote increased or enhanced sprint or high speed running performance, particularly for use on artificial and/or natural grass surfaces.

BRIEF DESCRIPTION OF THE DRAWINGS

The foregoing Summary, as well as the following Detailed Description of the Invention, will be better understood when considered in conjunction with the accompanying drawings in which like reference numerals refer to the same or similar elements in all of the various views in which that reference number appears. The attached figures include.

DETAILED DESCRIPTION OF THE INVENTION

Figure 1A:
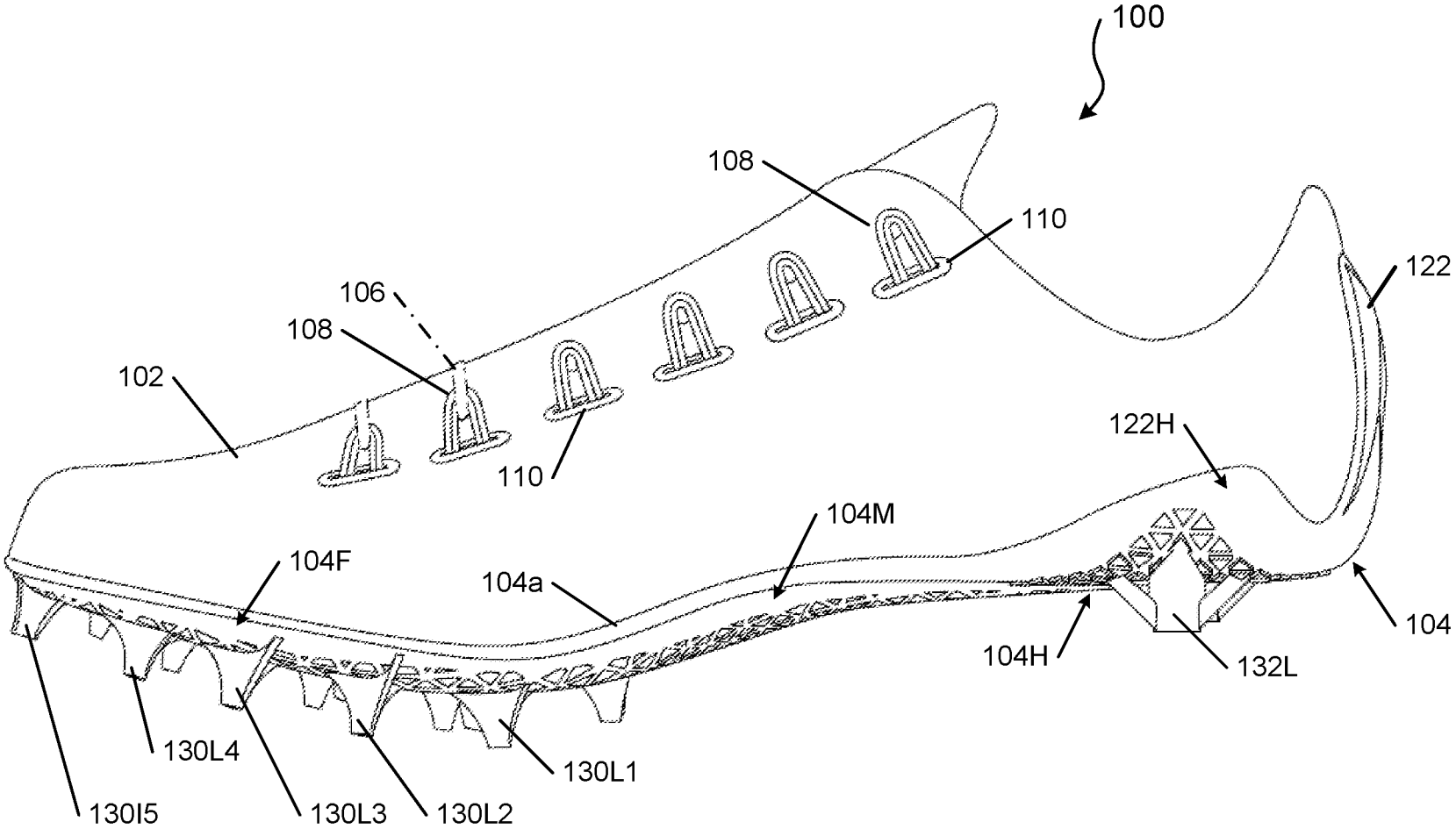
FIGS. 1A through 1G, which provide various views of an article of footwear (and/or various components or features thereof) in accordance with aspects of this invention, including: a lateral side view (FIG. 1A), a medial side view (FIG. 1B), a top view (FIG. 1C), a bottom view (FIG. 1D), a rear heel view (FIG. 1E), another medial side view (FIG. 1F), and another bottom view (FIG. 1G)

In the following description of various examples of structures, components, and methods according to the present invention, reference is made to the accompanying drawings, which form a part hereof, and in which are shown by way of illustration various example structures, environments, and methods according to this invention and/or in which aspects of the invention may be practiced. It is to be understood that other structures, environments, and methods may be utilized and that structural and functional modifications may be made to the specifically described structures and methods without departing from the scope of the present invention.

I. General Description of Aspects of this Invention

As noted above, aspects of this invention relate to cleat structures, sole structures including cleat structures, and articles of footwear (e.g., athletic footwear) that include such sole structures. Additional aspects of this invention relate to methods of making such cleats, sole structures, and/or articles of footwear.

A. Cleat Constructions According to Aspects of this Invention

Some aspects of this invention relate to cleat constructions that can be incorporated into articles of footwear, such as athletic footwear (and in some specific examples, football or soccer shoes). In some more specific examples, the cleats may be fixed or permanently incorporated into the sole structure of the article of footwear, including integrally formed with a plate or outsole component of the sole structure as a unitary, one-piece construction.

As a more specific example, cleats in accordance with at least some examples of this invention may include: (a) a cleat base; (b) a cleat free end; (c) a first side edge extending between the cleat base and the cleat free end, wherein the first side edge may have a first concave exterior surface over at least 50% of its height dimension (and in some examples, over at least 75% or even over at least 90% of its height dimension) between the cleat base and the cleat free end; (d) a second side edge extending between the cleat base and the cleat free end, wherein the second side edge may be flat or concave over at least 50% of its height dimension (and in some examples, over at least 75% or even over at least 90% of its height dimension) between the cleat base and the cleat free end; and (e) a third side edge extending between the cleat base and the cleat free end, wherein the third side edge may be flat or concave over at least 50% of its height dimension (and in some examples, over at least 75% or even over at least 90% of its height dimension) between the cleat base and the cleat free end. If desired, at least the central 50% (and in some examples, at least the central 75% or even at least the central 90%) of the first side edge of the cleat (with respect to a height dimension of that cleat) will have the concave exterior surface.

In some example cleat structures in accordance with this invention, at least 90% (and in some examples, at least 95%) of a perimeter length around the cleat at a first cleat height location between the cleat base and the cleat free end will be made up of the first, second, and third side edges (and the remainder of that perimeter length (if any) may be made up of corner or junction regions between adjacent side edges, e.g., with rounded corners, flattened corner edges, etc.). This first cleat height location (at which the perimeter length may be measured) may be located between 0.1 H and 0.9 H, wherein H is the overall or maximum cleat height dimension in a direction from the cleat base to the cleat free end.

As yet some additional examples, at least 90% (or even at least 95%) of a perimeter length around the cleat free end and/or around the cleat base may be made up of the first, second, and third side edges. The remainder of this perimeter length (if any) may be made up of corner or junction regions between adjacent side edges, e.g., with rounded corners, flattened corner edges, etc.

Some cleat constructions in accordance with examples of this invention will include one or more openings extending through the cleat, e.g., from the second side edge to the third side edge. The opening(s), when present, may take on any desired size, shape, orientation, and/or relative arrangement, provided that adequate material remains present to maintain the structural integrity and/or to support the intended use of the cleat.

Additional aspects of this invention relate to sole structures (e.g., outsoles, outsole plates, etc.) and/or articles of footwear that include one or more cleats of the various types described above. In such sole structures and/or articles of footwear, at least some of the cleat structures of the types described above will be provided in the forefoot area of the sole structure. Optionally, at least some of the cleat structure(s) will be oriented with respect to the overall sole structure and/or the article of footwear such that at least some of the cleats will have the concave exterior surface of the first side edge facing rearward, e.g., toward a rear heel area of the sole structure/article of footwear.

B. Sole Structures and Articles of Footwear According to Aspects of this Invention Additional aspects of this invention relate to sole structures for articles of footwear. Sole structures in accordance with some examples of this invention may include an outsole component having: (a) a first lateral perimeter cleat located along a lateral side of a forefoot area or a midfoot area of the outsole component, wherein the first lateral perimeter cleat includes a concave rear edge that faces a rear heel direction of the sole structure, (b) a second lateral perimeter cleat located along the lateral side of the outsole component and forward of the first lateral perimeter cleat, wherein the second lateral perimeter cleat includes a concave rear edge that faces the rear heel direction of the sole structure, (c) a first medial perimeter cleat located along a medial side of a forefoot area or a midfoot area of the outsole component, wherein the first medial perimeter cleat includes a concave rear edge that faces the rear heel direction of the sole structure, and (d) a second medial perimeter cleat located along the medial side of the outsole component and forward of the first medial perimeter cleat, wherein the second medial perimeter cleat includes a concave rear edge that faces the rear heel direction of the sole structure.

Additional cleats may be provided, if desired, e.g., along either side perimeters, in an intermediate area between the side perimeter cleats, at a rear heel area, etc. At least some of these cleats, particularly in the midfoot and/or forefoot areas of the sole structure, may have the various cleat features and structures described above (e.g., the concave rear edge).

Sole structures in accordance with other examples of this invention may have an outsole component that includes a base plate having a rear heel support portion, an arch support portion, and a forefoot support portion, wherein the base plate includes a V-shaped support structure having a lateral support member and a medial support member extending forward from a base support area located in a heel or rear midfoot area of the outsole component. At least some portions of this base plate may have a matrix structure, e.g., at one or more of a lateral side of the lateral support member, a medial side of the medial support member, a rear heel area (e.g., behind and/or as part of the base support area), between the lateral support member and the medial support member (e.g., at least in a forefoot area of the outsole component), etc. The matrix structure may be formed as spaced apart recesses that extend only partially through the outsole component; spaced apart openings that extend completely through the outsole component; small, separated raised areas; etc. The recesses, openings, and/or raised areas may be generally triangular shaped in some example structures according to this invention.

Sole structures in accordance with yet other examples of this invention may include an outsole component having a base plate at least in a forefoot area of the outsole component, wherein the base plate has a matrix structure including: (a) a first plurality of rib elements extending in a first direction (e.g., a front-to-back direction), (b) a second plurality of rib elements extending in a second direction (e.g., a rear medial-to-forward lateral direction), and (c) a third plurality of rib elements extending in a third direction (e.g., a forward medial-to-rear lateral direction) of the outsole component. This example outsole component further may include one or more three sided cleats extending from the base plate, wherein at least one of the three sided cleats includes: (a) a cleat base, (b) a cleat free end, (c) a first side edge extending between the cleat base and the cleat free end, (d) a second side edge extending between the cleat base and the cleat free end, and (e) a third side edge extending between the cleat base and the cleat free end, wherein one of the second plurality of rib elements aligns with (and optionally forms a continuous, unitary, one-piece structure with) a junction region between the first side edge and the second side edge, wherein one of the third plurality of rib elements aligns with (and optionally forms a continuous, unitary, one-piece structure with) a junction region between the first side edge and the third side edge, and wherein one of the first plurality of rib elements aligns with (and optionally forms a continuous, unitary, one-piece structure with) a junction region between the second side edge and the third side edge. The cleat(s) additionally may have any of the various structures or features described above. For example, at least some of the cleats may be shaped and/or oriented such that at least one side edge has a rearward heel facing, exterior concave wall, e.g., as described above.

The features of the various sole structures described above may be used in any desired combinations or subcombinations without departing from the invention. Sole structures in accordance with at least some examples of this invention may include other features as well, including one or more additional cleats of the types described above and/or different types of cleats (including removable or fixed cleats of any desired size, shape, or structure). As one additional potential feature that may be included in any of the sole structures described above, the outsole component further may include a rear heel support extending upward from the base plate at a rear heel area of the outsole component. This rear heel support may constitute a fin type structure, e.g., having a generally trapezoidal or triangular shape. As some more specific examples, this rear heel support may include a top edge or point, a first side edge extending downward from the top edge or point to a medial, bottom, rear heel area of the outsole component, and a second side edge extending downward from the top edge or point to a lateral, bottom, rear heel area of the outsole component. These side edges may constitute substantially linear or smoothly curved segments that are at least 1.5 inches long, and in some examples, at least 2 inches long or even at least 2.5 inches long. The rear heel support may be formed as a continuous, single piece structure with respect to the outsole base plate (which also may be a continuous, single piece structure with respect to one or more of the cleats).

Still additional aspects of this invention relate to articles of footwear that include an upper engaged with a sole structure having any of the various features, properties, combinations of features, and/or combinations of properties described above.

C. Methods of Making Sole Structures According to Aspects of this Invention

Still additional aspects of this invention relate to methods of forming cleats, sole structures, and/or articles of footwear according to any of the various examples described above. If desired, the cleats and/or outsole components described above may be made by molding processes, such as injection molding or the like. The cleats and outsole components may be made separately and then engaged with one another (e.g., by mechanical connectors, by cements or adhesives, etc.) or they may be integrally formed as a unitary, one piece construction (e.g., by a molding step).

As additional examples, if desired, the cleats and/or at least some portions of the sole structures (e.g., outsole components, optionally including a rear heel support or other heel counter type structure) may be fixed or permanently formed together as a unitary, one-piece construction, e.g., by selective laser sintering, stereolithography, or other three-dimensional printing or rapid manufacturing additive fabrication techniques. These types of additive fabrication techniques allow the cleats, outsole base plates, matrix structures, support members, heel counters, and/or rear heel supports to be built as unitary structures. Sole structures of the types described above (including those made by the methods described above) may be incorporated into an article of footwear, e.g., engaged with one or more upper components), in any desired manner, including in manners that are conventionally known and used in the footwear art (e.g., by fixing the upper to the sole structure using cements or adhesives, mechanical connectors, and/or the like).

Given the general description of features, aspects, structures, processes, and arrangements according to certain embodiments of the invention provided above, a more detailed description of specific example structures and methods in accordance with this invention follows.

II. Detailed Description of Example Structures and Methods According to this Invention Referring to the figures and following discussion, various articles of footwear, footwear components, and/or features thereof in accordance with the present invention are described. The footwear depicted and discussed are football shoes, but the concepts disclosed with respect to various aspects of this invention may be applied to a wide range of cleated or other athletic footwear styles, including, but not limited to: soccer shoes, baseball shoes, softball shoes, etc.

FIGS. 1A through 1G illustrate various views of an article of footwear 100 (also called a "shoe" herein) in accordance with some aspects of this invention that is well suited to support and enhance sprinting/running speed on artificial grass/natural grass surfaces. The shoe 100 has a very lightweight design, including an upper 102 directly engaged with an outsole component 104*a* of a sole structure 104, e.g., by cements or adhesives, by mechanical connectors, or the like. While no separate midsole component is shown in this specific example shoe structure 100, a midsole component (e.g., polymeric foam, one or more foam columns, one or more fluid-filled bladders, one or more mechanical shock absorbing elements, etc.) may be provided, if desired, in some footwear structures 100 in accordance with this invention (e.g., inside and/or outside of the foot-receiving chamber of the shoe 100).

The upper 102 may have any desired construction and/or may be made from any desired material(s) without departing from this invention. In this illustrated example shoe 100, the upper 102 is designed to be extremely lightweight and aerodynamic, to promote speed. For some athletes, the foot may move as fast as about 50 mph when sprinting, and thus structures as part of a shoe 100 can produce significant drag at those speeds. Therefore, in some specific examples of shoe structures 100 in accordance with this invention, the upper 102 may be made from a knit fabric material that is covered or coated (or "skinned") with a thin microlayer of material, such as a thermoplastic polyurethane skin material or other skin materials. Examples of knitted footwear uppers are described, for example, in U.S. Pat. No. 7,347,011 (which is entirely incorporated herein by reference), and examples of "skin" materials are described, for example, in U.S. Patent Appln. Publ. No. 2011/0088285 (which publication is entirely incorporated by reference). In some shoe structures 100, the outer surface of the upper 102 (e.g., the exposed skin material) may be smooth and seamless to further reduce or minimize drag. As another option, if desired, the exterior surface of the upper 102 (e.g., the exterior "skin") may be dimpled to further promote the aerodynamic properties of the upper 102.

This example upper 102 further includes a conventional shoe lace 106 engaged with a series of lace engaging structures provided along opposite sides of the instep area of the upper 102. Any type of lace engaging structures may be used without departing from this invention, including, for example, grommets or simple openings through the upper material at the instep area, as are conventionally known and used in this art. In this specifically illustrated footwear structure 100, however, the lace 106 engages loop elements 108 (e.g., formed of fabric) that extend inside the upper 102 or between layers of the upper 102 (e.g., as shown by loop elements 108 extending into openings 110 formed along the upper 102 to allow access between upper layers). The exposed edges of openings 110 may be reinforced to prevent tearing or fraying. In some examples of this aspect of the invention, the lace loop elements 108 may extend to and/or engage strap components that at least partially wrap around the foot and help conform the upper 102 to the shape of the wearer's foot. For example, the lace loop elements 108 (or one or more straps or other structure engaged with them) may extend to an area between the upper 102 and the sole structure 104 (and optionally all the way around the plantar surface of the foot) so that when the lace 106 is tightened, this wraps and tightens the loop elements 108 (and any attached structures) around the sides and/or bottom of the wearer's foot. Examples of such adjustable and/or dynamic fit and foot securing structures are shown, for example, in U.S. Patent Appln. Publ. Nos. 2012/0011744 and 2012/0198720, which publications are entirely incorporated herein by reference.

The sole structure 104 of FIGS. 1A through 1G now will be described in more detail. As shown, this example sole structure 104 constitutes an outsole component (or plate) 104*a* that spans the entire length of the shoe 100 and includes a heel support area 104H, a forefoot support area 104F, and a midfoot or arch support area 104M located between the heel and forefoot support areas. The outsole component 104*a* of this example shoe structure 100 constitutes a single, unitary, one-piece construction, although other, multi-part outsole constructions may be possible without departing from some aspects of this invention. As another option, if desired, the outsole component 104*a* may support less than the entire plantar surface of a wearer's foot (e.g., it may be located only or primarily in the forefoot area, etc.).

As noted above, this example outsole component 104*a* includes a base plate that spans the longitudinal length of the shoe 100 and includes the support areas 104H, 104M, and 104F. The top surface of the base plate forms a relatively smooth, contoured surface for supporting the plantar surface of a wearer's foot (optionally through a strobel element 102S, insole, midsole, sockliner, bootie, or other element provided to directly contact the wearer's foot). This example base plate generally provides a V-shaped support structure having a lateral support member 112L and a medial support member 112M extending forward from a base support area 112B located in a heel or rear midfoot area of the outsole component 104*a*. The lateral support member 112L and the medial support member 112M constitute solid (and potentially somewhat thickened) ribs or areas of outsole material (e.g., a nylon or other material, such as nylon 11) that meet at (or immediately forward of) the base support area 112B. As shown in FIG. 1D, the base plate has a matrix structure at a lateral side of the lateral support member 112L, at a medial side of the medial support member 112M, and rearward of the junction between members 112L and 112M (at least at the lateral side of heel support member 118). This matrix structure will be described in more detail below.

As further shown in FIG. 1D, the base plate of the outsole component 104*a* in this example has an optional opening 114 defined through it in front of the base support area 112B and between the lateral support member 112L and the medial support member 112M. This opening 114 may have any desired size and/or shape without departing from this invention, including extension to the toe area of the sole structure 104 (e.g., to completely open the space between lateral support member 112L and medial support member 112M in front of their junction at the base support area 112B). In other examples, the opening 114 (when present) is provided at least in a midfoot/arch region of the outsole component 104*a*. In this specifically illustrated structure, the opening 114 is substantially triangular shaped and extends continuously in a front-to-rear direction of the outsole component 104*a* for at least 2 inches (and in some examples, at least 2.5 inches or even at least 3 inches) and runs from the base support area 112B at least to the forefoot area of the outsole component 104*a*. The opening 114 can help control the flexibility and/or stiffness of the outsole component 104*a* particularly in the forefoot and/or midfoot areas, e.g., to somewhat decouple the lateral and medial sides of the outsole component, to provide relative flexibility between the lateral and medial sides, and/or to provide a more natural motion feel (e.g., to promote better pronation as the wearer lands a step and the weight/force on the foot rolls from the lateral side to the medial side of the foot).

In the outsole component 104*a* of FIG. 1D, the opening 114 terminates in the midfoot/forefoot area such that an intermediate forefoot support plate portion 112I is provided as part of the base plate of the outsole component 104*a* between the lateral support member 112L and the medial support member 112M forward of the opening 114. This intermediate forefoot support plate portion 112I, while not necessary in all footwear structures in accordance with this invention, helps provides a more comfortable and stable feel when a wearer sprints in the shoe 100, as the complete forefoot of the wearer is supported.

As mentioned above, the bottom surface of this example outsole component 104*a* has a matrix structure. The matrix structure can take on any desired form without departing from this invention. In this illustrated example outsole component 104*a*, the matrix cells 116 are formed as openings and/or recesses in the areas between three adjacent sets of rib elements, namely, rib elements 116A that extend in a front-to-rear direction of the outsole component 104*a*, rib elements 116B that extend in a rear medial-to-front lateral direction of the outsole component 104*a*, and rib elements 116C that extend in a forward medial-to-rear lateral direction of the outsole component 104*a*. The matrix cells 116 may extend partially or completely through a thickness of the outsole component 104*a*. While other arrangements are possible, in this specifically illustrated example, the matrix cells 116 at the lateral side of the lateral support member 112L constitute recesses that extend partially through a thickness of the outsole component 104*a*, the matrix cells 116 at the medial side of the medial support member 112M constitute recesses that extend partially through the thickness of the outsole component 104*a*, and the matrix cells 116 in the intermediate forefoot support plate portion 112I constitute openings that extend completely through the outsole component 104*a*. The matrix cells 116 in the base support area 112B and to a lateral side of heel support member 118 constitute recesses that extend partially through the outsole component 104*a*. This matrix structure (with recesses and/or openings) helps reduce the overall weight of the outsole component 104*a* and provide the ability to affect and/or control the flexibility and/or strength of the outsole component 104*a* (including front-to-back or side-to-side flexibility). The local sizes (e.g., width, height, etc.), relative orientations, and spacings of rib elements (e.g., 116A, 116B, 116C) also may allow one to affect and/or control outsole flexibility and/or strength.

Because of the specific number, shapes, and relative orientations of the rib elements 116A, 116B, and 116C in this example outsole component 104*a*, the matrix cells 116 are generally triangular shaped. Other matrix cell shapes are possible, however, without departing from this invention, such as round, oval, elliptical, square, rectangular, hexagonal, irregular shapes, etc. Other matrix cell sizes also may be used without departing from the invention (and may allow control over the strength, flexibility, and/or stiffness of the outsole component 104*a*). A single outsole component 104*a* may include matrix cells 116 of different shapes and/or sizes, if desired.

The outsole component 104*a* of FIG. 1D has the matrix structure with recessed or open matrix cells 116 extending over the lateral heel side, the sides of the midfoot (around opening 114), and substantially the entire forefoot area of the bottom surface of the outsole component 104*a*. The heel area of the outsole component 104*a* is separated by a support member 118 (e.g., a solid rib or length of material) that extends across the heel in a rear lateral-to-forward medial direction. While the matrix cells 116 on the lateral side of the support member 118 constitute recesses or openings, the matrix cells 120 on the medial side of support member 118 constitute projections (e.g., triangular shaped) from the base surface level of outsole component 104*a*. Projection matrix cells of this type could be used at other areas of the outsole component 104*a*, if desired.

Figure 1B:
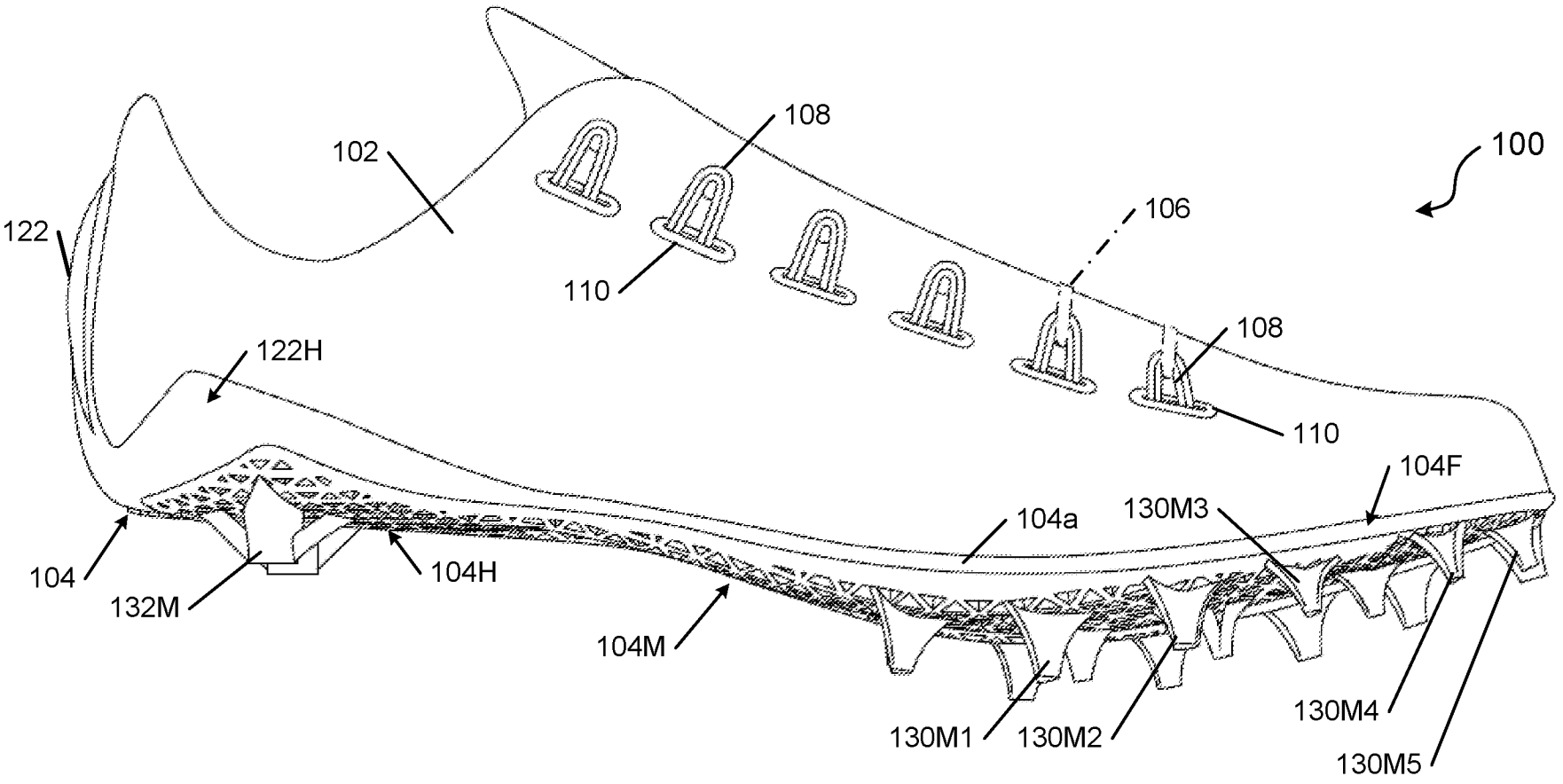
Figure 1C:
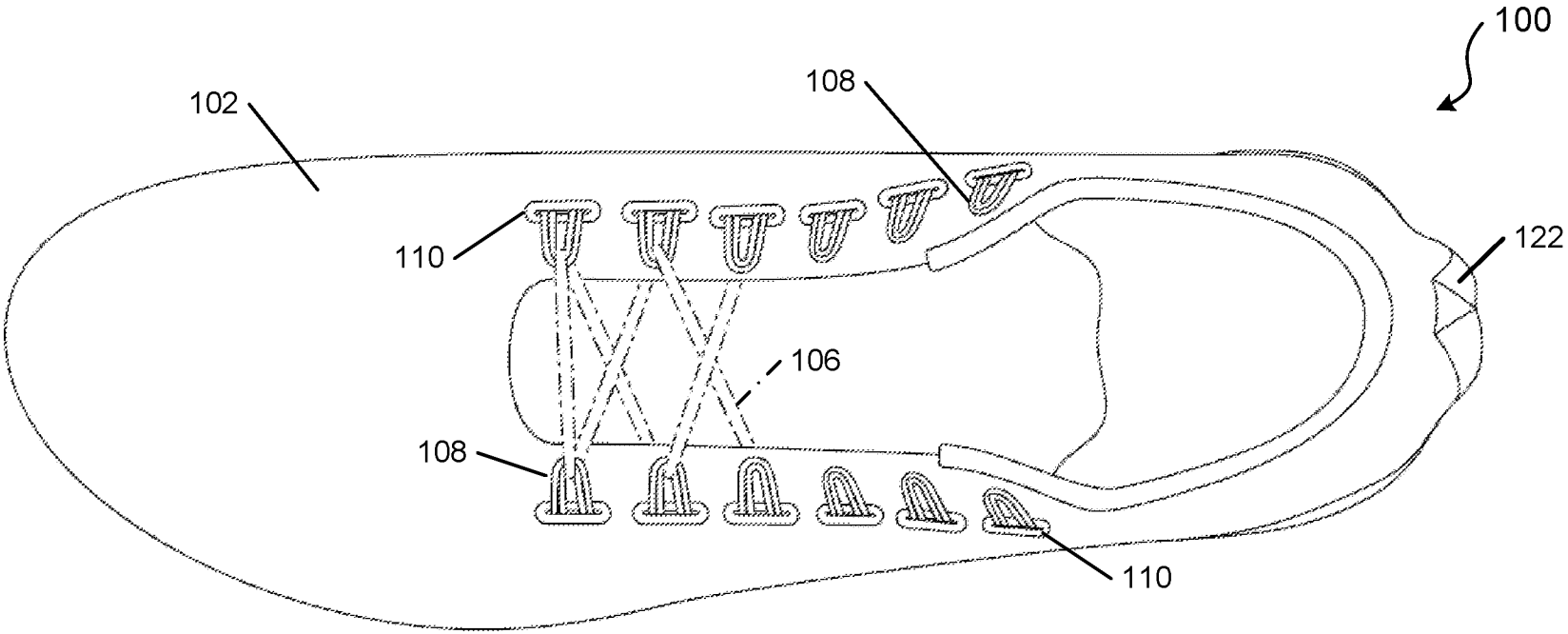
Figure 1D:
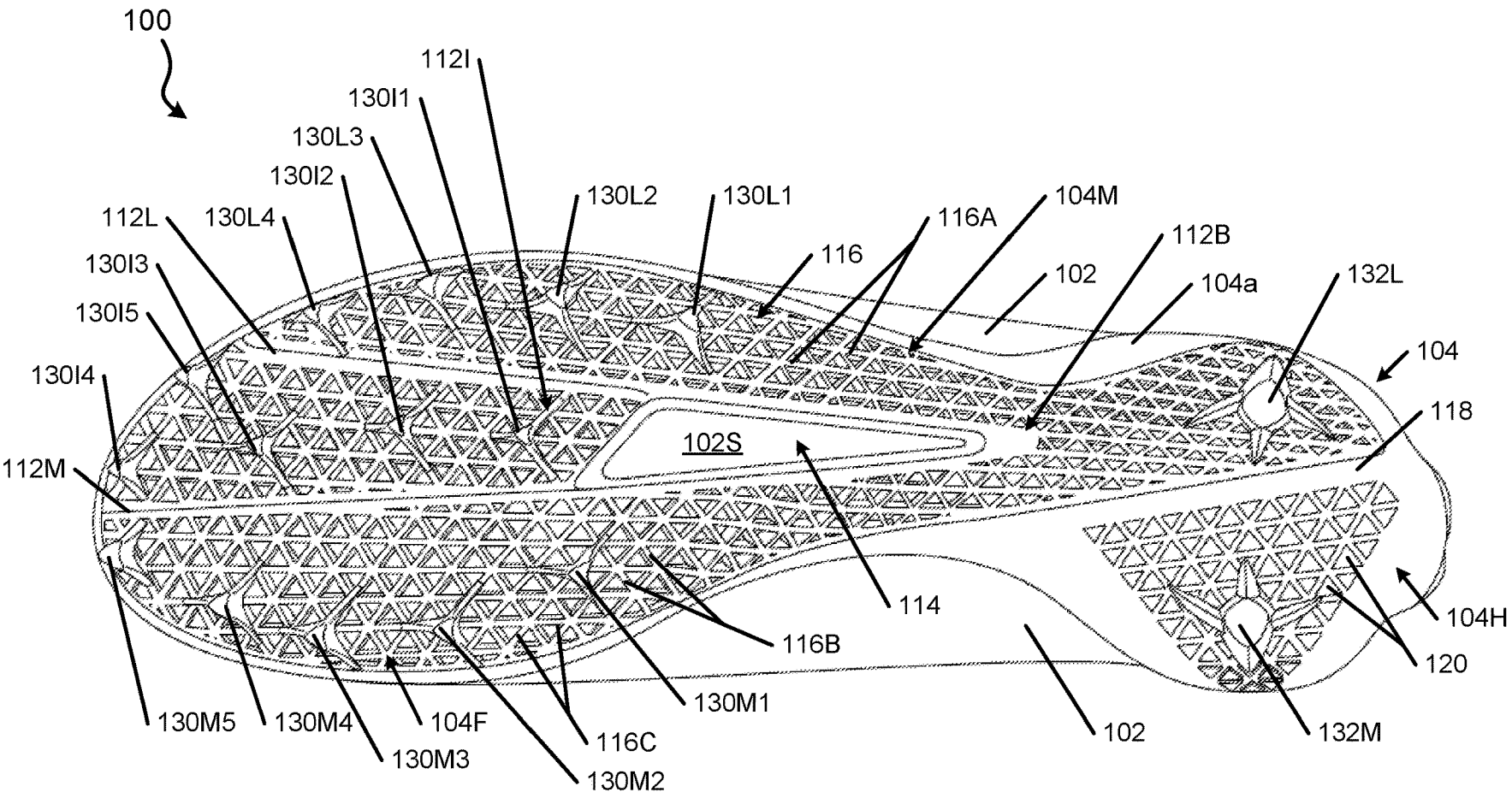
Figure 1E:
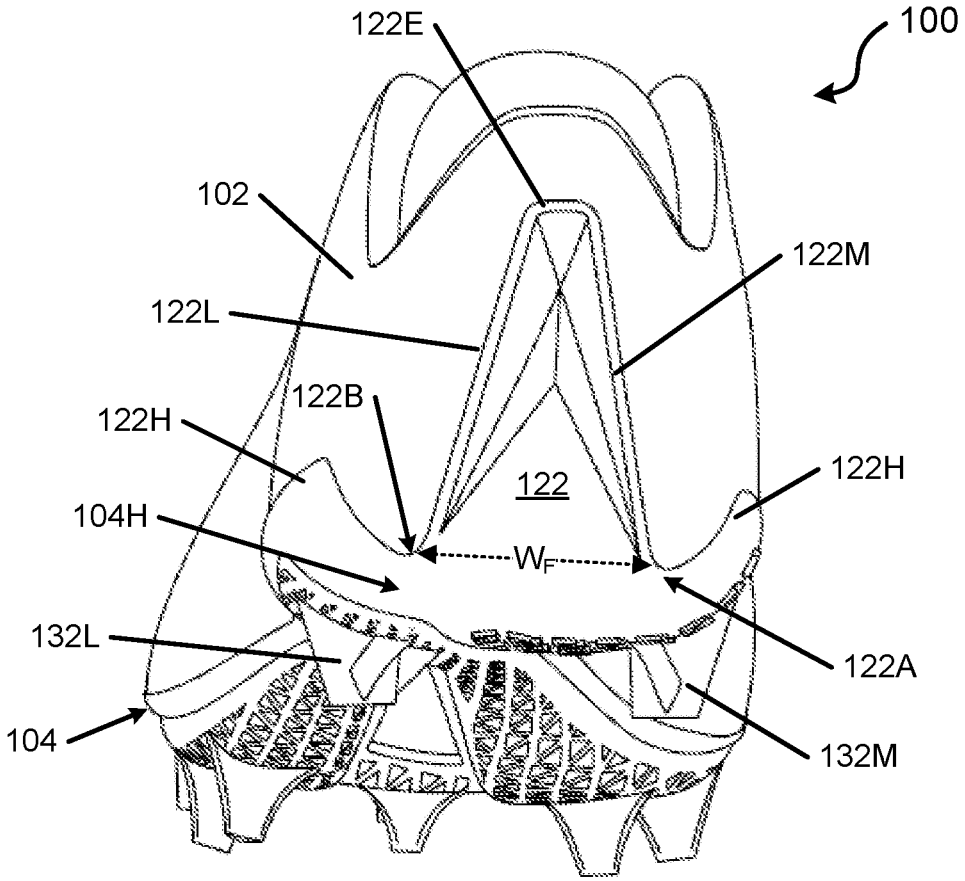

FIGS. 1A, 1B, and 1E further illustrate that the outsole component 104*a* of this example sole structure 104 includes a heel support extending upward from the base plate of the outsole component 104*a* at a heel area of the outsole component 104*a*. Any desired type, style, or shape of heel support may be used in some sole structures in accordance with this invention, including heel supports akin in size and shape to conventional heel counters (e.g., that support the sides and rear of the heel).

Because this example shoe 100 is specifically targeted for maximizing sprinting speed, however, the heel support of this example constitutes an extreme rear heel support 122, e.g., in the form of a rear heel fin having a generally trapezoidal or triangular shape. More specifically, as best shown in FIG. 1E, the rear heel support 122 includes a top edge or point 122E, a medial side edge 122M extending downward from the top edge or point 122E to a medial, bottom, rear heel area 122A of the outsole component 104*a*, and a lateral side edge 122L extending downward from the top edge or point 122E to a lateral, bottom, rear heel area 122B of the outsole component 104*a*. In at least some example structures in accordance with the invention, one or both of the medial side edge 122M and the lateral side edge 122L will include a downwardly extending curved or linear segment at least 1.5 inches long, and in some examples, at least 1.75 inches long, at least 2 inches long, or even longer. The rear heel support 122 provides a base against which the wearer's rear heel pushes when a wearer is sprinting in a forward direction while still providing a very lightweight overall sole plate, e.g., by eliminating much of the lateral side heel and medial side heel support material provided in more conventional heel counter structures. The rear heel support 122 may include ridges, corners, or bends, e.g., to affect and allow control of overall stiffness of the heel support 122.

Because less side heel support is needed in a shoe primarily used for forward sprinting, in this illustrated example sole structure 104 relatively low side heel supports 122H are provided at the medial and lateral sides of the heel that cup and position the lower portions of the wearer's heel. In some examples, with the sole structure 104 sitting on a contact surface (see FIG. 1F), these side heel supports 122H will extend to a maximum height $H_1$ from the ground or contact surface to a level that is less than 50% of the total height $H_2$ of the heel fin 122 from the ground or contact surface (and in some examples, less than 35% or even less than 25% of the total height). Of course, taller and/or additional side heel supports could be provided, if desired, inside or outside of the upper 102 (or between layers of the upper 102), e.g., depending on the intended use of the shoe 100.

FIGS. 1A, 1B, and 1D further illustrate the cleat arrangement for this example shoe 100. As best shown in FIG. 1D, the lateral perimeter side or edge area (e.g., the area to the lateral side of lateral support member 112L) includes four midfoot/forefoot cleat components 130L1 through 130L4 arranged along the perimeter side or edge of the outsole component 104*a*, wherein cleat 130L4 is located forward of cleat 130L3, which is forward of cleat 130L2, which is forward of 130L1. Cleat "location," as used herein, may be considered as the geometric center of the free end of the cleat. The medial perimeter side or edge area (e.g., the area to the medial side of medial support member 112M) includes five midfoot/forefoot cleat components 130M1 through 130M5 arranged along the perimeter side or edge of the outsole component 104*a*, wherein cleat 130M5 is located forward of cleat 130M4, which is forward of cleat 130M3, which is forward of cleat 130M2, which is forward of cleat 130M1. The intermediate forefoot support plate portion 112I of this example outsole component 104*a* also includes five cleats, namely, cleats 130I1 through 130I4, which are substantially aligned in the front-to-rear or longitudinal direction of the outsole component 104*a*, and cleat 130I5, which is located at the front toe perimeter area to the lateral side of and between cleats 130I3 and 130I4. If desired, at least some of the intermediate cleats 130I1-130I5, when present, may be made somewhat smaller than at least some of the lateral side or medial side cleats. The heel area of outsole component 104*a* includes a single lateral side cleat 132L and a single medial side cleat 132M, although additional heel cleats (such as a rear central heel cleat) may be provided, if desired. Other cleat arrangements, numbers, and/or orientations are possible in some example structures in accordance with this invention.

Figure 1F:
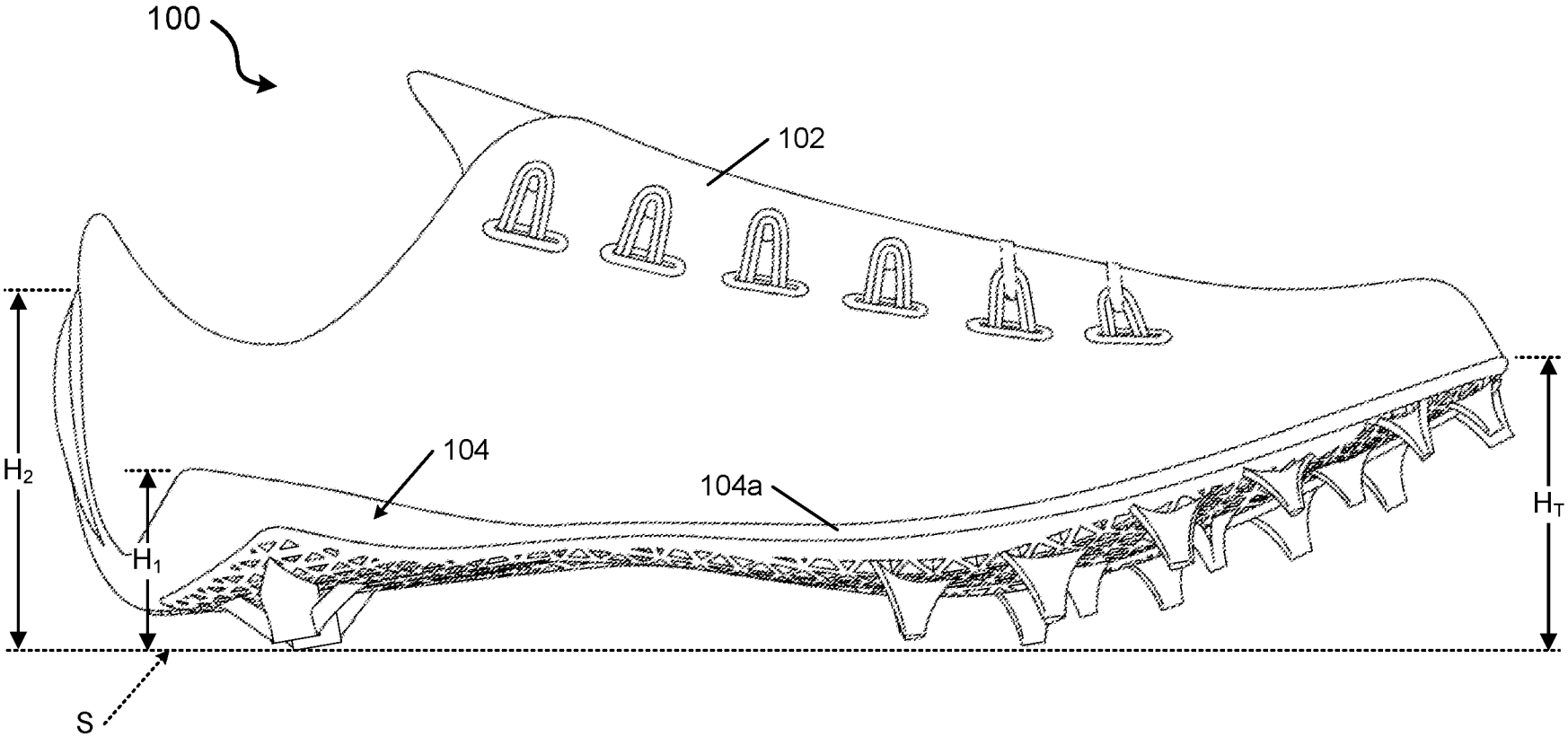
Figure 1G:
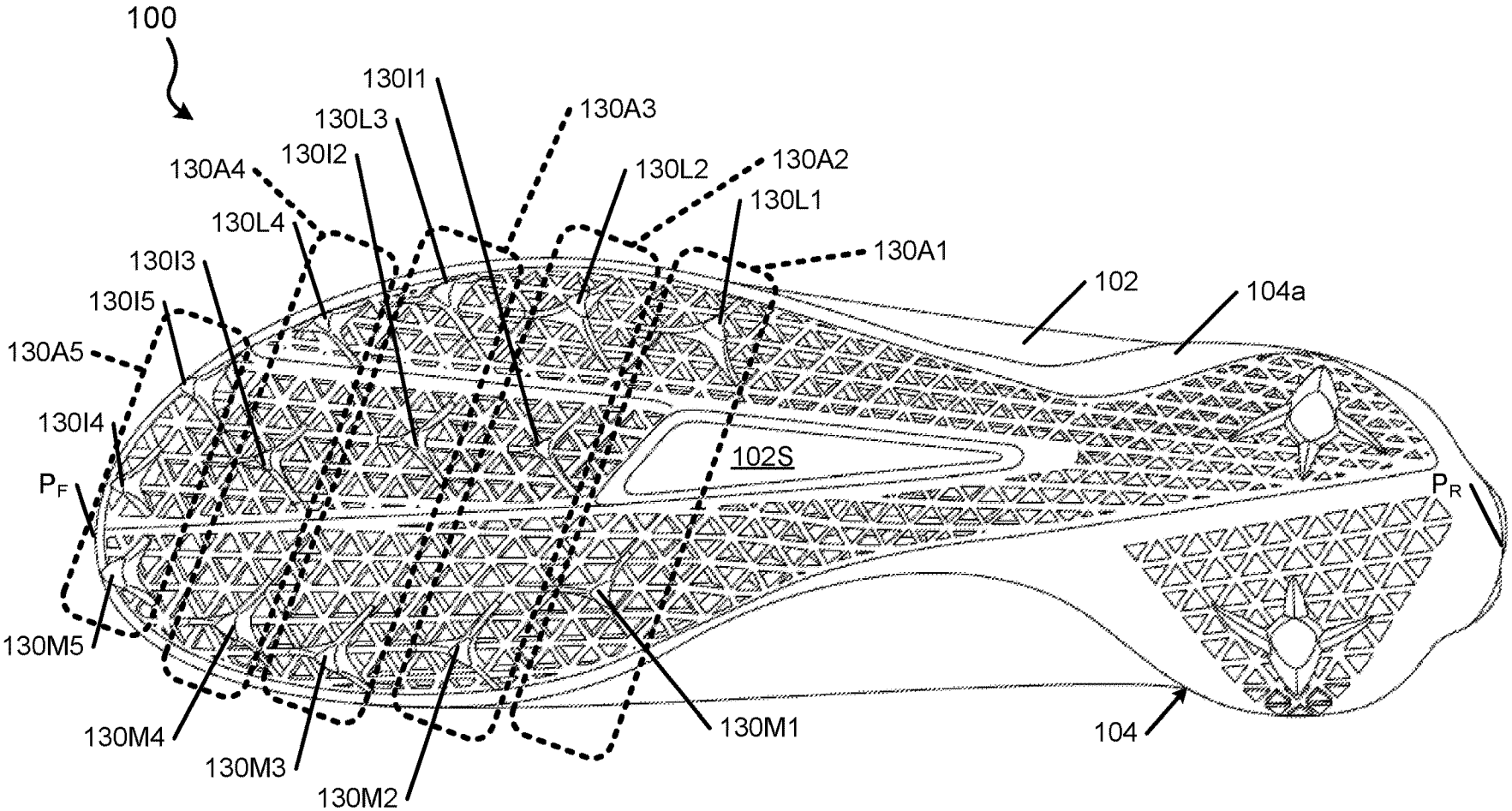

The cleat arrangement of FIG. 1D (and as also shown in FIG. 1G), however, is particularly well suited for sprinting. When sprinting (e.g., for 40 yards or even more), an athlete may spend all or almost all of the foot ground contact time on his/her toes. Also, when sprinting, the athlete typically contacts the ground first on the lateral midfoot or forefoot area and then the foot rolls forward and inward such that the weight/force shifts across the center of the forefoot to the medial side of the forefoot and forward for toe off (e.g., at the big toe and potentially the adjacent toe). The cleats of this example outsole component 104*a* are oriented to support this type of motion and weight shift (e.g., with transverse cleat sets 130A1-130A4 oriented in a rear lateral-to-forward medial direction, as generally shown in FIG. 1G). For example, as shown in FIG. 1G, cleat set 130A1 includes cleats 130L1 and 130M1 oriented such that the rearmost medial cleat 130M1 is forward of the rearmost lateral cleat 130L1 (an intermediate cleat could be provided with this cleat set 130A1, if desired). The next transverse cleat set 130A2 is oriented such that cleats 130L2, 130I1, and 130M2 are oriented in a rear lateral-to-forward medial direction (and optionally substantially aligned) with cleat 130L2 rearward of at least cleat 130M2. The next transverse cleat set 130A3 is oriented such that cleats 130L3, 130I2, and 130M3 are oriented in a rear lateral-to-forward medial direction (and optionally substantially aligned) with cleat 130L3 rearward of at least cleat 130M3. The next transverse cleat set 130A4 is oriented such that cleats 130L4, 130I3, and 130M4 are oriented in a rear lateral-to-forward medial direction (and optionally substantially aligned) with cleat 130L4 rearward of at least cleat 130M4. The remaining forefoot cleats in this specific example sole structure 104 (cleat set 130A5 including cleats 130M5, 130I4, and 130I5) are positioned toward the very front edge of the shoe 100 for the toe off phase of the sprint step cycle. As noted above, a cleat's location, as used in this context, may be considered as the geometric center of the exposed, free end of the cleat. The "front-to-rear direction" of the sole structure 104 may be determined as the direction connecting the rearmost point $P_R$ and forwardmost point $P_F$ of the sole structure 104.

Additional potential features of sole structures and/or cleat structures in accordance with at least some aspects of this invention will be described below in conjunction with FIGS. 2A through 2I. FIGS. 2A-2I illustrate various views of a sole structure 204 that is similar to the sole structure 104 shown in FIGS. 1A through 1G, but without an upper attached. Accordingly, the reference numbers used in FIGS. 1A through 1G also will be used in FIGS. 2A through 2I to refer to the same or similar parts, and at least some of the description thereof will be omitted. The features of the sole structure and/or cleats of FIGS. 2A-2I also could be used in the sole structures and/or cleats of FIGS. 1A-1G, if desired.

Figure 2A:
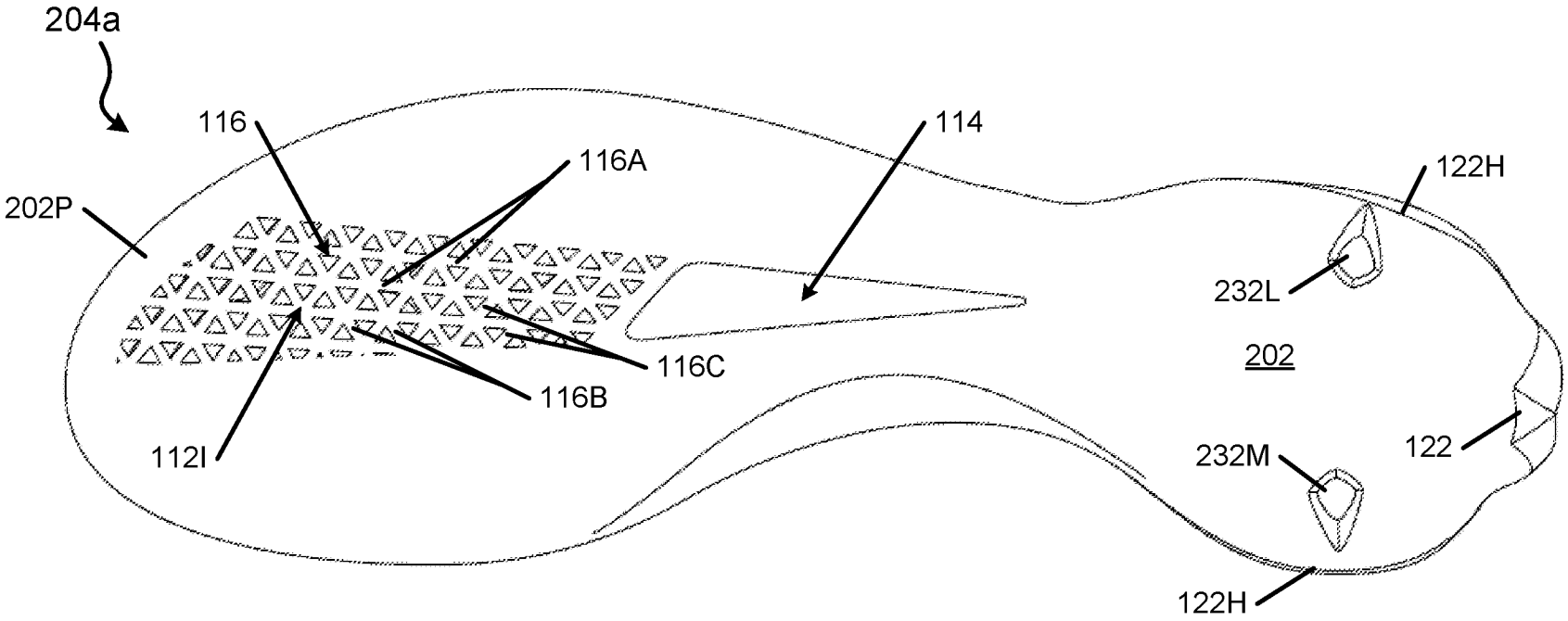
FIGS. 2A through 2I, which provide various views of a sole member (and/or various components or features thereof) in accordance with aspects of this invention, including: a top view (FIG. 2A), a bottom view (FIG. 2B), a lateral side view (FIG. 2C), a rear heel view (FIG. 2D), bottom perspective views (FIGS. 2E and 2F), a close up view of an individual cleat (FIG. 2G), a close up, perspective view of a portion of the bottom forefoot area (FIG. 2H), and a close up, perspective view of a portion of the bottom heel area (FIG. 2I).
Figure 2B:
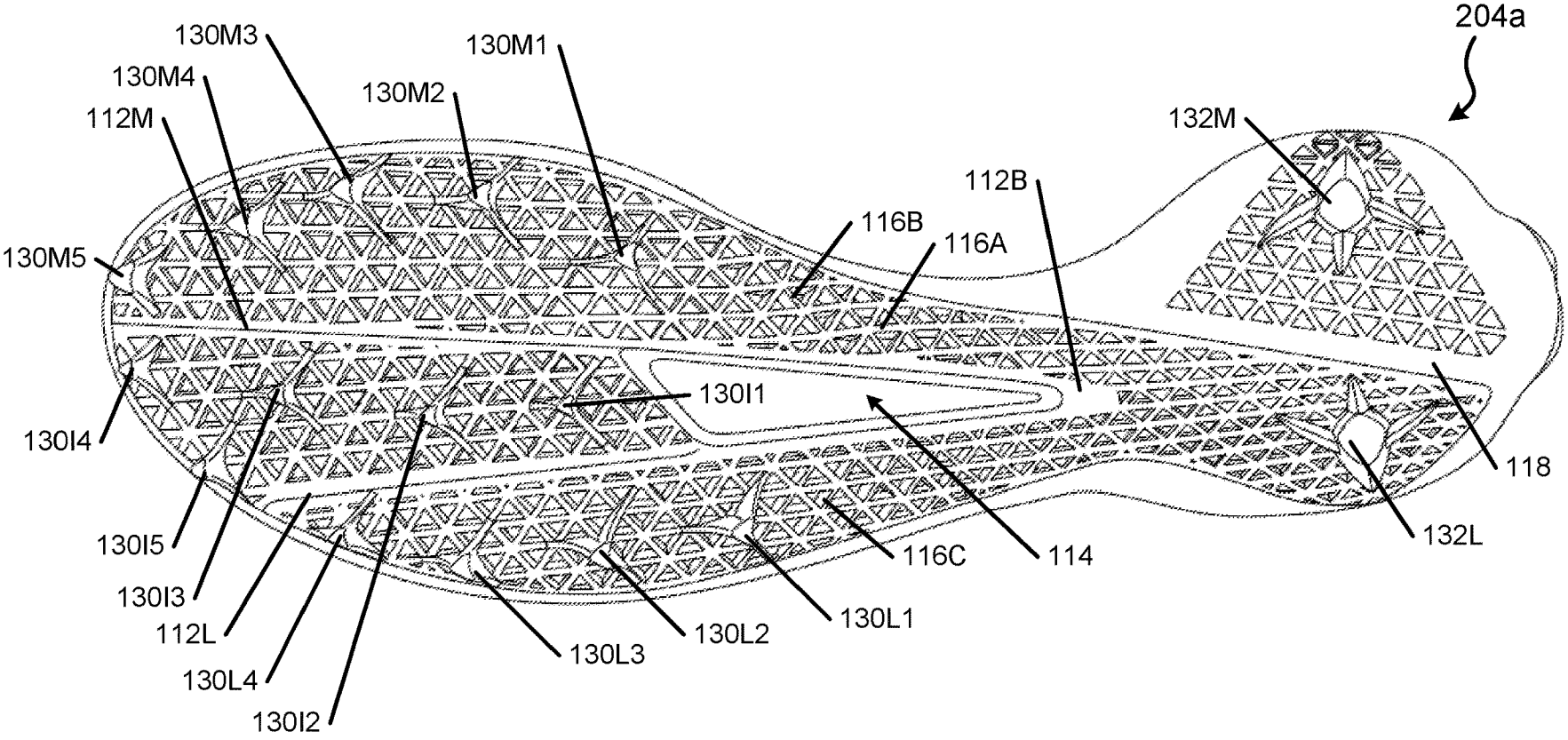
Figure 2C:
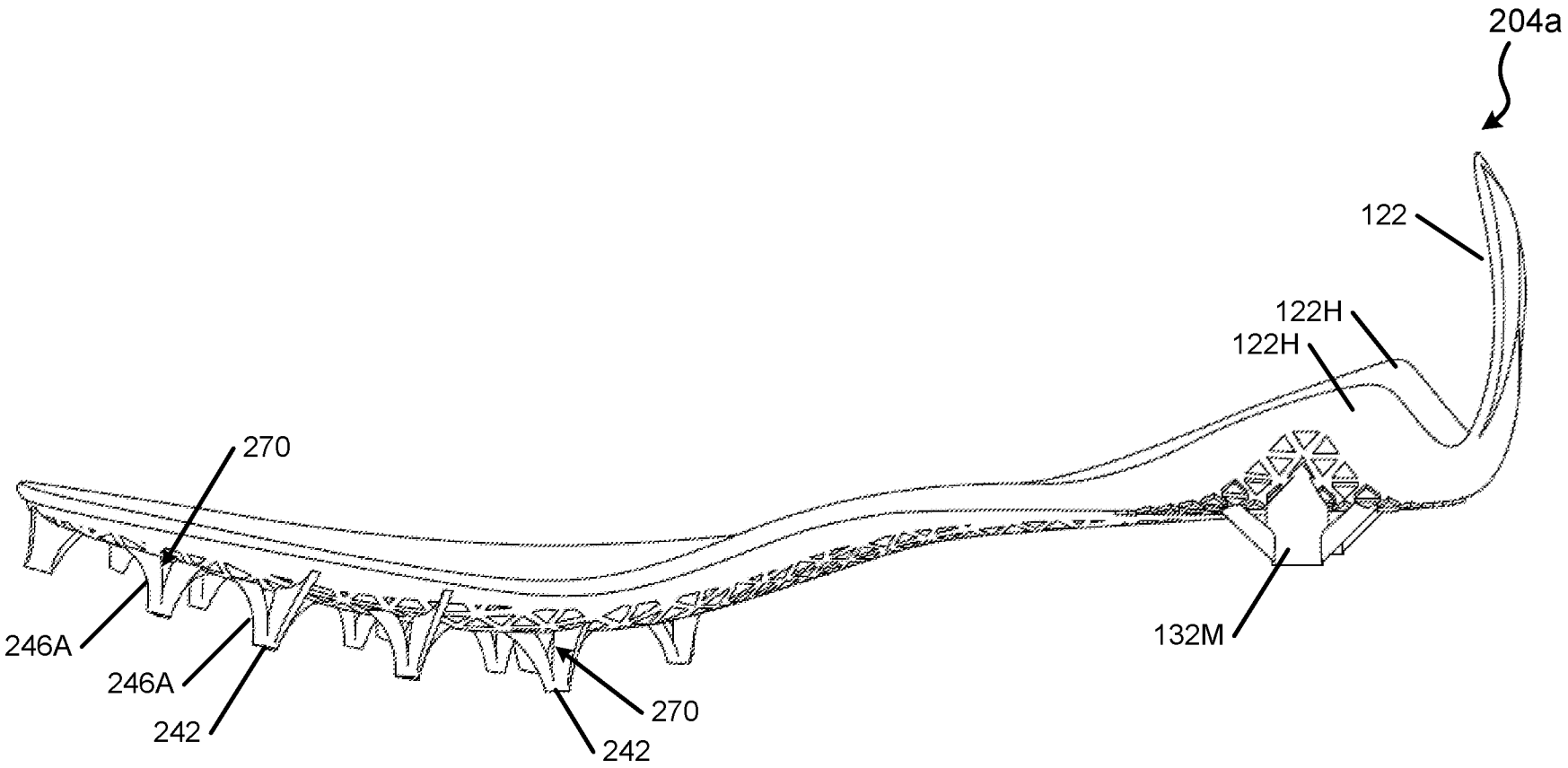
Figure 2D:
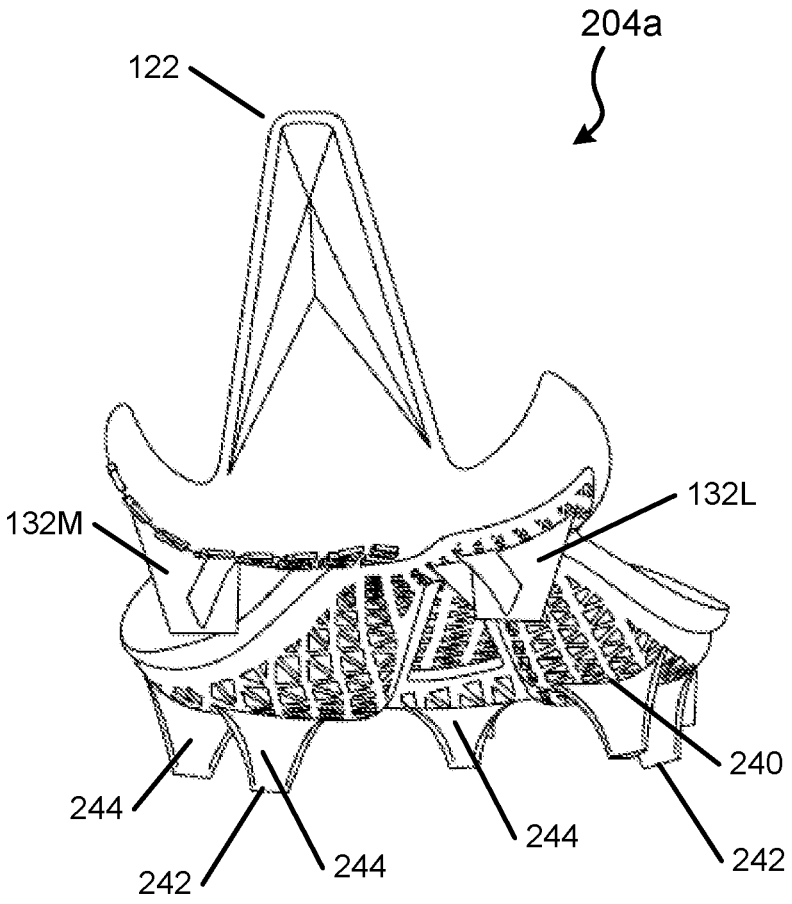

FIGS. 2A and 2B show top and bottom views, respectively, of an outsole component 204*a* that is similar to the outsole component 104*a* shown and discussed above in conjunction with FIGS. 1A through 1G. As apparent from the top view of FIG. 2A, this example outsole plate 204*a* has a continuous top surface 202 for supporting a plantar surface of a wearer's foot. The top view also helps illustrate the areas of the matrix structure formed as recesses in the bottom surface of the outsole component 204*a* (e.g., at the lateral perimeter sides and edges and the medial perimeter sides and edges) and those formed as openings 116 (e.g., at the intermediate forefoot support area 112I). The entire perimeter area 202P of the outsole component 204*a* top surface 202 has a solid or filled in structure and serves as a bonding perimeter, e.g., 8-15 mm (or even 10-12 mm) of solid material around the entire top perimeter of outsole component 204*a* for attaching the outsole component 204*a* with another footwear component, such as an upper 102 and/or a strobel 102S or another sole component (such as a midsole component). FIG. 2A further shows that the heel based cleats 132L and 132M are formed as hollow members (i.e., the top surface 202 of the outsole member 204*a* includes interior cavities 232L and 232M that extend into the interior of the cleats 132L and 132M, respectively). Hollowing out the heel cleats 132L and 132M in this example outsole component 204*a* structure helps reduce overall weight and helps provide a lightweight outsole component 204*a*.

FIGS. 2C through 2I provide additional views that help illustrate various features of the outsole component 204*a* and particularly the cleat structures in accordance with at least some examples of this invention. For example, as shown in these figures, at least some of the cleats (e.g., one or more (or even all) of the forefoot cleats) will have a generally three sided cleat construction including: (a) a cleat base 240 (e.g., located by the base surface of the outsole component 204*a*); (b) a cleat free end 242 (e.g., the surface that first engages the ground); (c) a first side edge 244 extending between the cleat base 240 and the cleat free end 242, wherein the first side edge 244 has a first concave exterior surface 244A over at least 50% of its height dimension H (see FIG. 2H) between the cleat base 240 and the cleat free end 242 (and in some examples, the concave exterior surface 244A will extend at least 75% or even at least 90% of the height dimension H); (d) a second side edge 246A extending between the cleat base 240 and the cleat free end 242; and (e) a third side edge 246B extending between the cleat base 240 and the cleat free end 242. A first junction region 250A joins the first side edge 244 and the second side edge 246A; a second junction region 250B joins the first side edge 244 and the third side edge 246B; and a third junction region 250C joins the second side edge 246A and the third side edge 246B.

The junction regions 250A, 250B, and/or 250C may be sharp corners, rounded corners, short flat (or concave) walls, or the like. In some examples, the junction regions 250A, 250B, and/or 250C will be wider at the cleat base area 240 and narrow or taper (optionally to a sharp corner) moving toward the cleat free end 242. At least some of the individual cleats may be constructed such that at least 90% (and in some examples, at least 95%) of a perimeter length around the cleat at a first cleat height location between the cleat base 240 and the cleat free end 242 is made up of the length of the first side edge 244 plus the length of the second side edge 246A plus the length of the third side edge 246B. The remainder of the perimeter length around the cleat at this first cleat height location may constitute length associated with the junction regions 250A, 250B, and 250C such that the cleat essentially has a three sided structure. The "first cleat height location" at which the cleat perimeter length is measured can be located somewhere along the height dimension H of the cleat somewhat above the cleat base 240 and somewhat below the cleat free end 242. As some more specific examples, the "first cleat height location" may be located between 0.1 H and 0.9 H, wherein H is the cleat height in a direction from the cleat base 240 to the cleat free end 242. As additional potential features, if desired, at least 90% (or even at least 95%) of a perimeter length around the cleat free end 242 and/or around the cleat base 240 may be made up of the length of the first side edge 244 plus the length of the second side edge 246A plus the length of the third side edge 246B at that location (e.g., with the remainder of the perimeter length around the cleat at these ends constituting length associated with the junction regions 250A, 250B, and 250C).

If desired, at least some portions of either or both of the second side edge 246A and the third side edge 246B may have a flat or even concave exterior surface over at least 50% of its height dimension (and in some examples, the flat or concave exterior surface of these edges 246A and/or 246B will extend at least 75% or even at least 90% of that edge's height dimension). The concave edges may make the cleats somewhat sharper and/or enable them to more readily penetrate the ground. The relatively small sized free end 242 (and relatively sharp corners at the junction regions 250A-250C, when present) can help provide good surface penetration, e.g., on natural or artificial grass surfaces.

The concave exterior surface 244A of cleat edge 244 described above may provide additional functions, as well. As shown in FIGS. 2B, 2D, 2E, and 2F (as well as FIGS. 1D and 1G), the cleats in this outsole component 204*a* (as well as outsole component 104*a* discussed above) are oriented so that the concave exterior surface 244*a* of the cleat edge 244 faces a rear heel area and direction of the outsole component 204*a* and/or a rear heel area and direction of the shoe 100. While it is not required, in these illustrated example outsole components 104*a* and 204*a*, all of the forefoot and/or midfoot cleats of the example outsole components 104*a* and 204*a* have this cleat orientation (with the concave exterior surface 244*a* of the cleat edge 244 facing a rear heel area and direction of the outsole component 204*a* and/or a rear heel area and direction of the shoe 100). In this manner, the concave exterior surface 244A of cleat edge 244 provides a relatively large, strong base surface (i.e., surface 244A) oriented perpendicular to a force direction applied to the cleat when a wearer is sprinting in a forward direction.

By orienting all or substantially all of the forefoot cleats in this same general manner (e.g., the lateral perimeter or side cleats, the intermediate cleats, and/or the medial perimeter or side cleats), solid traction and a strong base is provided throughout the forefoot contact phase of a sprinting step cycle (e.g., as the forefoot contacts the grounds (e.g., at the lateral midfoot or forefoot area) and the force of the step rolls forward and from the lateral side to the medial side of the shoe, as described above). The sets 130A1-130A4 of forefoot cleats (optionally substantially aligned in the rear lateral-to-forward medial direction as described above in conjunction with FIG. 1G) having this concave cleat side edge 244A orientation also help provide the solid traction and strong base for sprinting as this lateral to medial weight/force transfer occurs across the foot. The concave rear exterior surface 244A of the cleats may be thought of as providing a "scoop" or "shovel" type rear structure to help provide a solid, non-slipping base for push off. The cleats are arranged to provide great traction during the drive phase of a sprint and throughout the sprint.

Figure 2E:
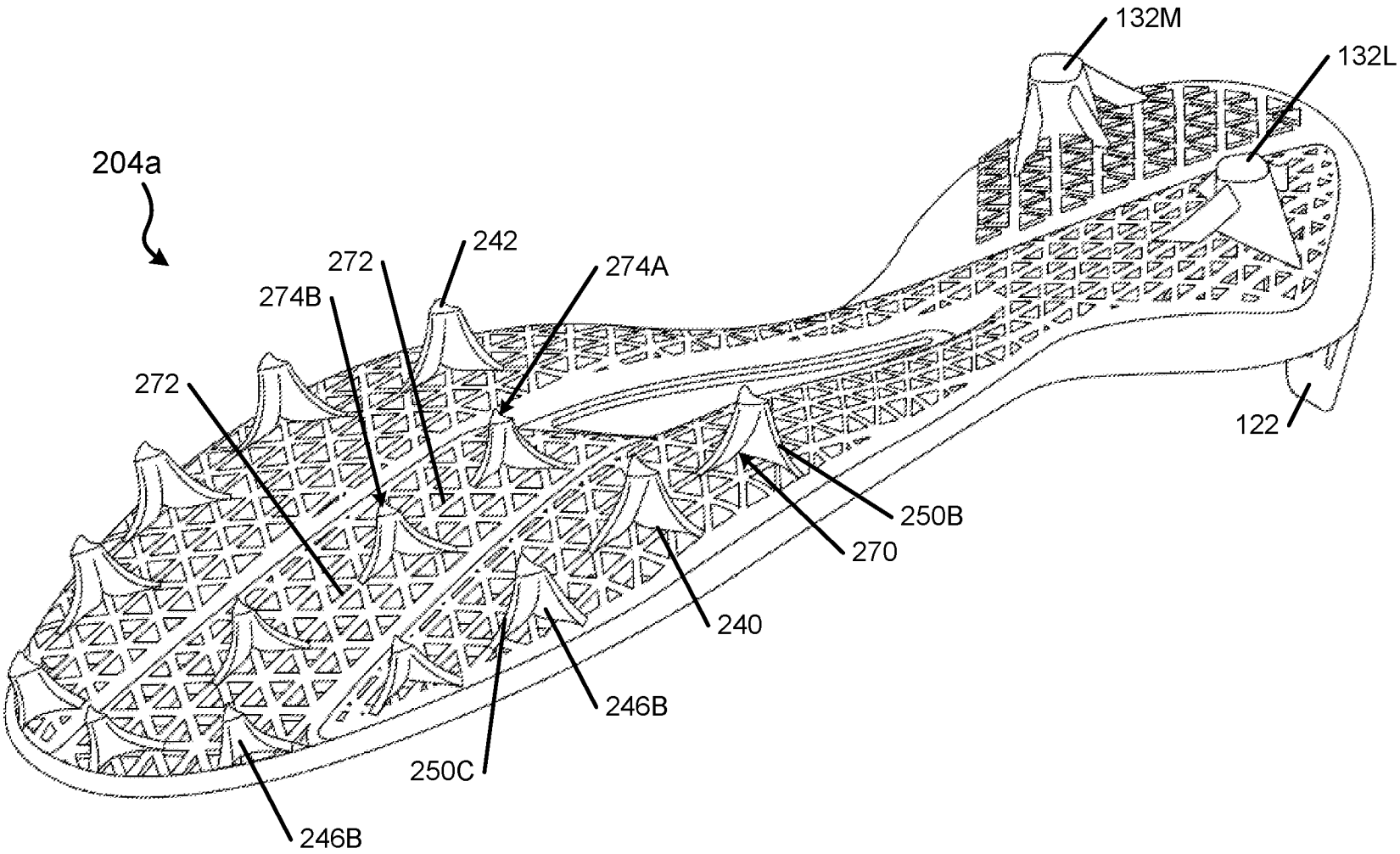
Figure 2F:
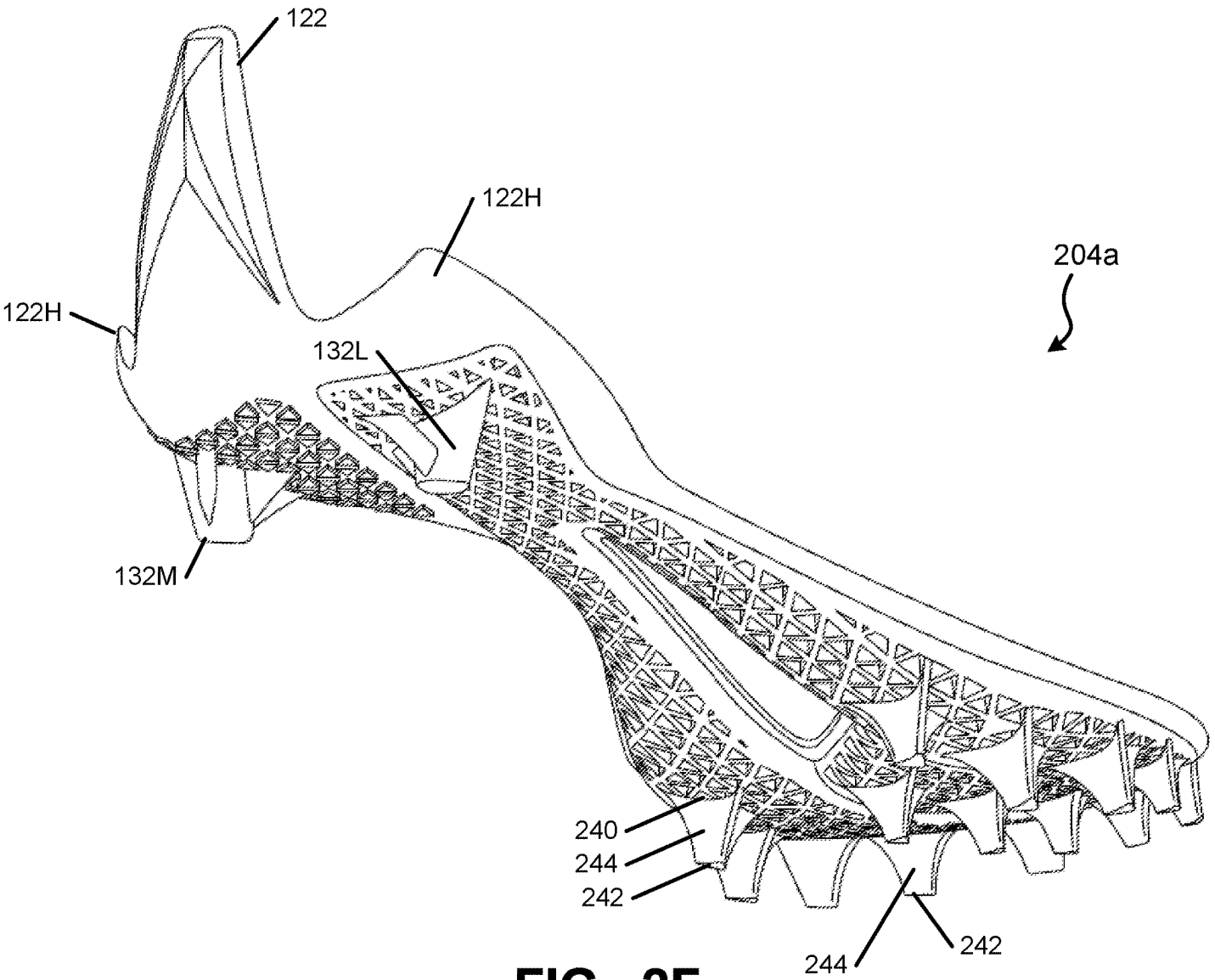
Figure 2G:
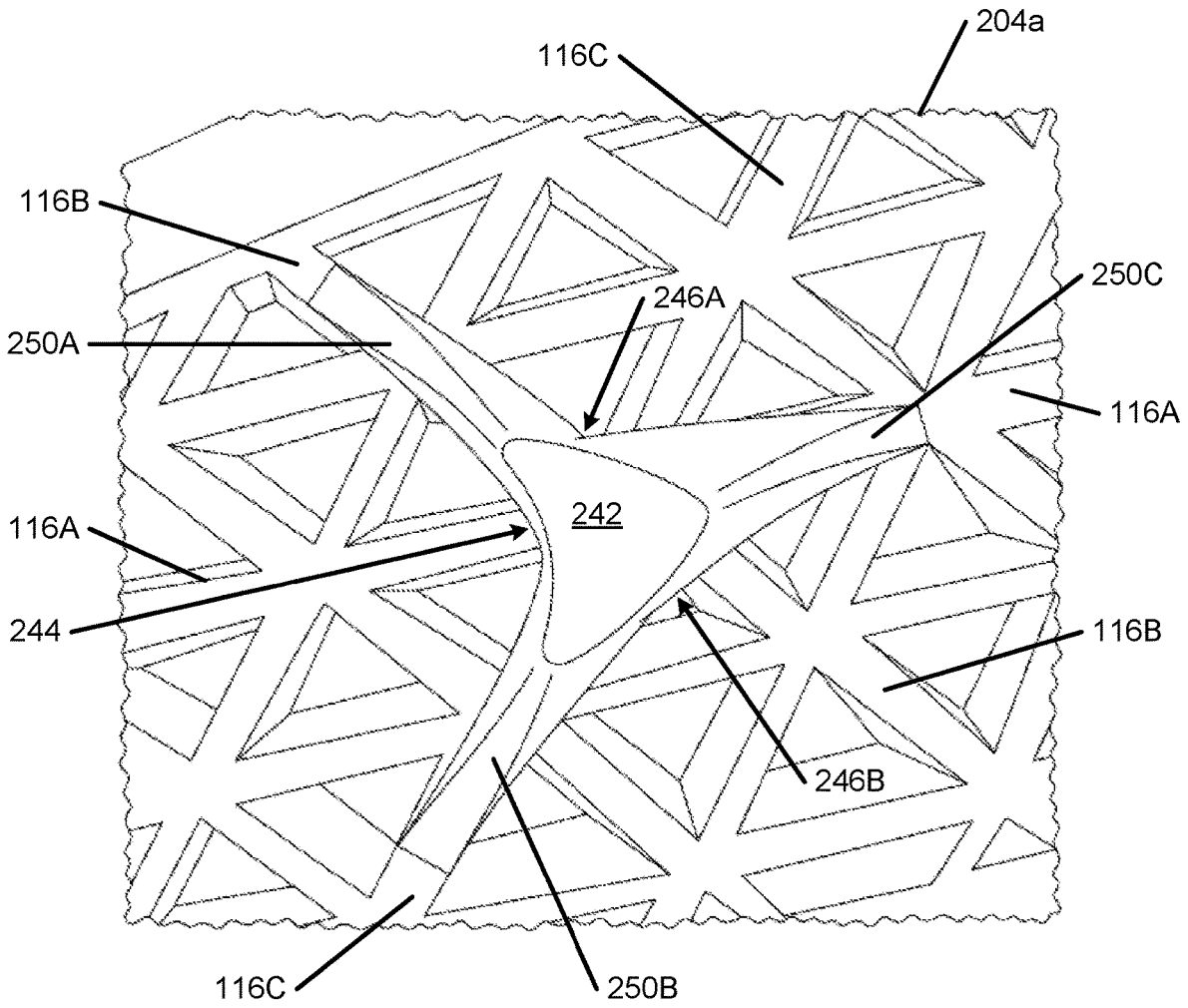
Figure 2H:
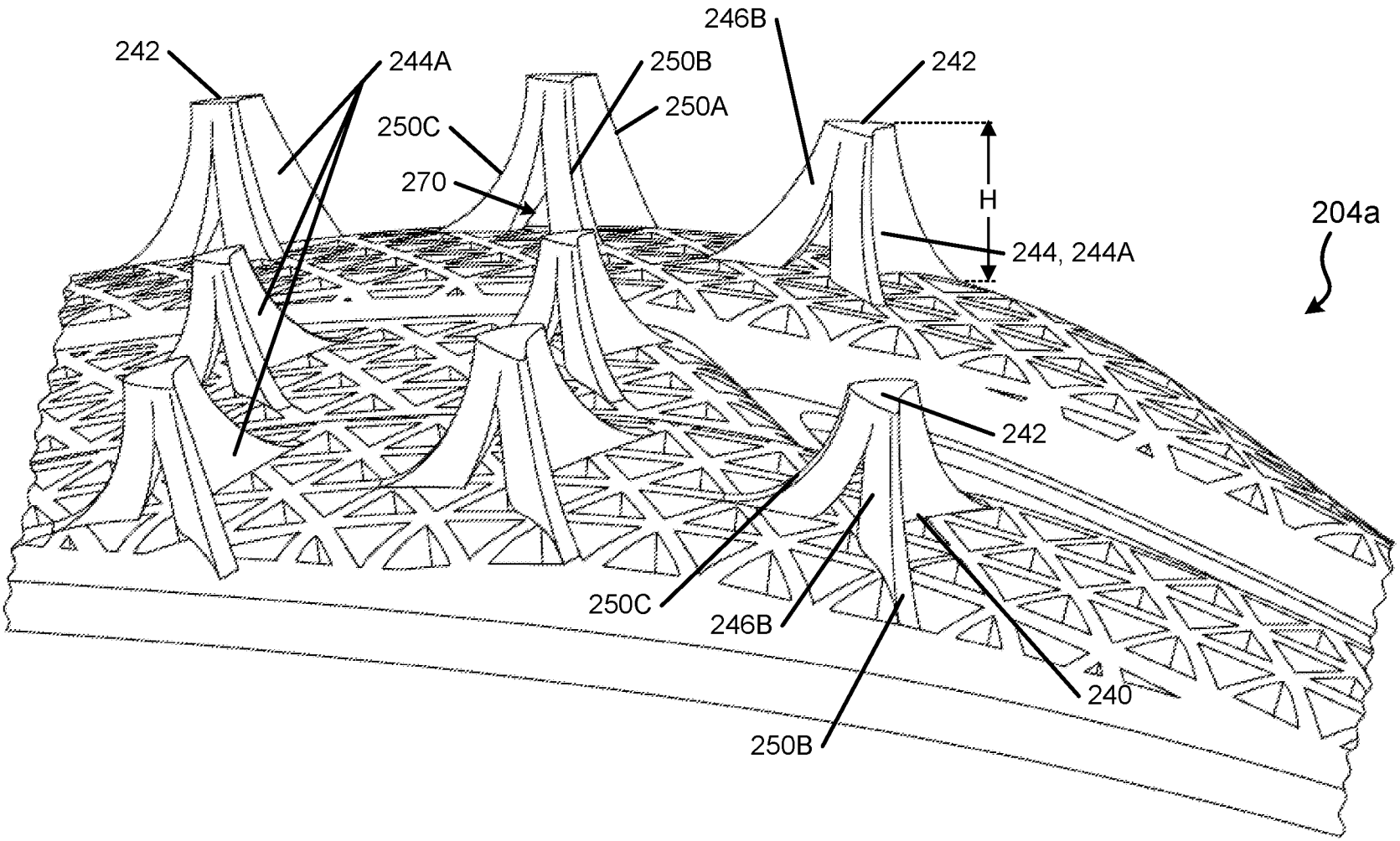
Figure 2I:
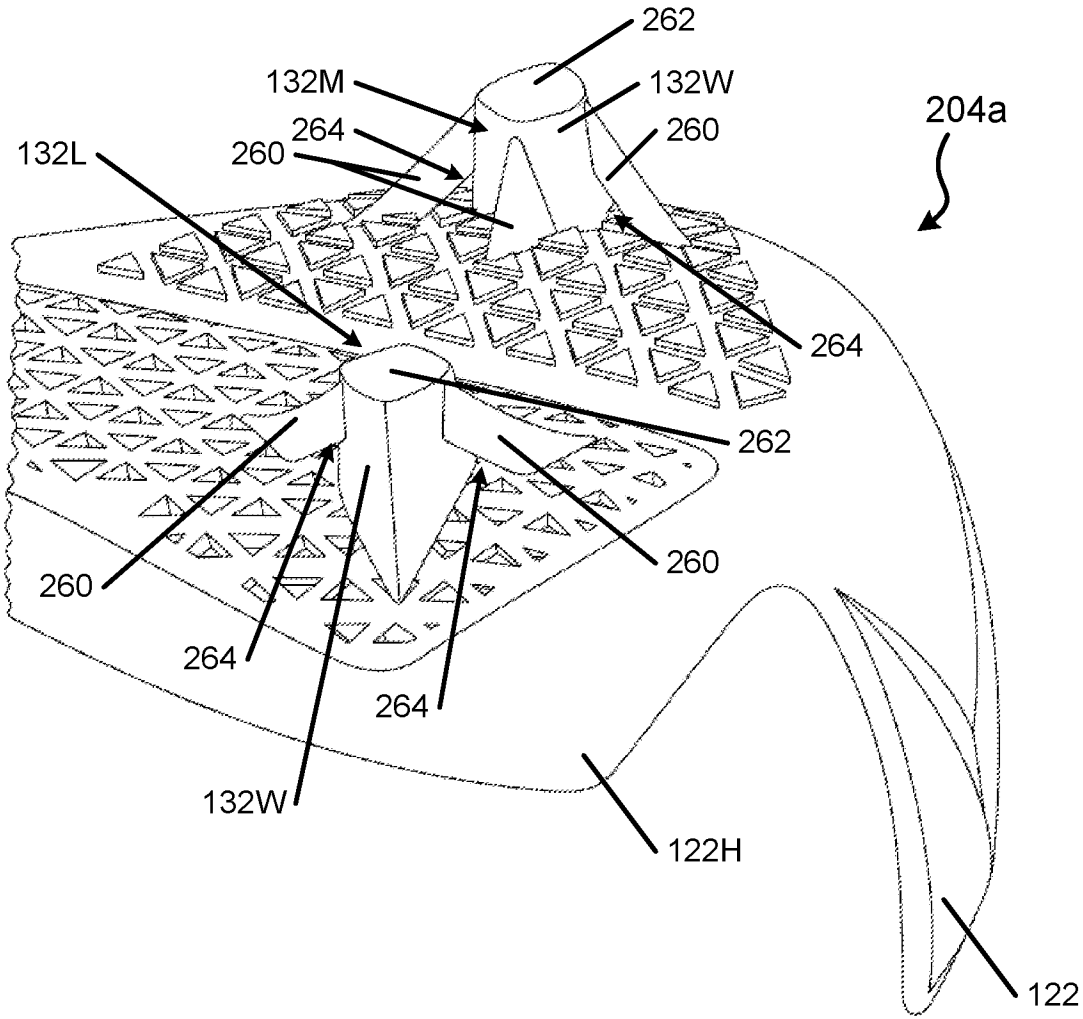

While they may have the same constructions, shape, and/or orientation, in these illustrated example outsole structures 104*a*/204*a*, the heel cleats 132L and 132M have a different structure and construction from the forefoot cleats. FIG. 2I (as well as other figures, such as FIG. 2D) shows that the heel cleats 132L and 132M have a generally round cross sectional shape, optionally with one or more support structures 260 arranged around the cleat side edges. The support structures 260 may extend from at or near the cleat free end 262 to the base plate area of the outsole component 204*a*. In the illustrated examples, at least some of the cleat support structures 260 (e.g., the front-to-back cleat support structures 260) are formed so as to define an opening 264 between the support structure 260 and the main outer wall 132W of the cleats 132L and 132M. While no opening 264 of this type is required, the elimination of this additional material helps reduce the weight of the overall sole structure (at least as compared to the weight of the sole structure if these areas were filled with material). Of course, other types and styles of heel cleats (or no heel cleats) may be provided in the heel area, if desired, without departing from this invention, including cleat constructions without support structures 260 of the types shown herein.

One difference between the outsole component 104*a* of FIGS. 1A through 1G and the outsole component 204*a* of FIGS. 2A through 2I relates to at least some of the forefoot and/or midfoot cleat structures. All of the forefoot/midfoot cleats in the outsole component 104*a* are solid or have an uninterrupted outer surface (i.e., no holes), whereas at least some of the forefoot/midfoot cleats in outsole component 204*a* (and optionally all of these cleats) have an opening 270 defined through them. In the illustrated example, the openings 270 extend through the cleats from the second side edge 246A through to the third side edge 246B. Note, for example, FIGS. 2C, 2E, and 2H. These openings 270 allow further reduction in the weight of the outsole component 204*a*. The openings 270, when present, may be present in all cleats or in just some cleats (e.g., in the larger cleats toward the rear of the forefoot area and/or in the midfoot area). The openings 270 may have any desired sizes and/or shapes without departing from this invention, including sizes and shapes different from those shown in these drawings. For example, if desired, the openings 270 may be rounded or elliptical shaped, or two or more openings 270 may be provided through a single cleat without departing from the invention. As another alternative, if desired, one or more openings may be provided between the rear facing concave wall 244 and one or both of the other side walls 246A and/or 246B.

Sole structures, including outsole components 104*a* and/or 204*a* may be made of any desired materials and/or in any desired manner without departing from this invention, including from conventional materials and/or in conventional manners as are known and used in the art. For example, if desired, the outsole components 104*a* and/or 204*a* may be molded (e.g., injection molding) from thermoplastic polyurethanes, nylons, rubbers, and/or other materials (including conventional outsole materials). As a more specific example, the cleat base area (including any desired heel support, such as a heel counter or the rear heel fin 122 and/or the matrix structure shown in the figures) may be injection molded, and cleats of the types described above (or other desired types) may be removably or permanently engaged with the cleat base area, e.g., in a conventional manner (e.g., by cements or adhesives, by mechanical connectors, etc.). As another option, if desired, the cleats may be molded as a unitary, one-piece construction with the cleat base area (e.g., by injection molding). If the manufacturer desires to have some cleats with openings defined through them (e.g., openings 264 and/or 270), the openings can be provided (e.g., drilled, cut, lasered, etc.) in the cleat structures after the molding step is completed. Optionally, if desired, the matrix structure (or some portions thereof, such as the recesses and/or openings 116) also may be formed in a post-molding step.

As another alternative, however, the outsole components 104*a* and/or 204*a* may be created (e.g., in the form illustrated) by a rapid manufacturing additive fabrication process, e.g., using selective laser sintering (SLS), stereolithography, and/or 3D printing techniques. Such fabrication techniques allow the outsole components 104*a* and/or 204*a* to be "built-up" in a layer-by-layer manner from a computer file that includes three dimensional data regarding the desired three-dimensional structure of the outsole components 104*a* and/or 204*a*. Such fabrication techniques allow production of cleat structures with undercuts (such as openings 264 and/or 270), cantilevers, overhanging areas, and the like (e.g., structures difficult to mold because of the undercuts). As some more specific examples, if desired, the cleats may be formed so that the free end 242 has a somewhat larger area than the areas of at least some cross sections located above the free end 242 (e.g., so that the top of at least one edge 244, 246A, and/or 246B and/or at least one junction area 250A, 250B, and/or 250C curves outward as it gets closer to the free end 242). Additive fabrication techniques of this type also allow the entire outsole components 104*a* and/or 204*a* to be produced as unitary, single piece structures, if desired, including the base plate with the cleats, although at least some separately attached cleat elements may be provided on outsole components produced by rapid manufacturing additive fabrication techniques, if desired. Outsole structures 104*a*, 204*a* of the types described herein may be formed using nylon SLS materials (e.g., nylon 11) commercially available from 3D Systems, Inc., e.g., under the "DURAFORM®" brand name.

While it also may be possible with molding techniques, the use of rapid manufacturing additive fabrication techniques also allows a manufacturer to create some interesting structural features for an outsole component 104*a*, 204*a*, if desired. For example, as illustrated in FIGS. 1D, 2B, 2E, 2F, 2G, and 2H, the various cleats (particularly the forefoot/midfoot cleats) may be integrally formed as part of the outsole component's matrix structure. As described above, the outsole components 104*a* and 204*a* may be formed with a base plate (or base level) in their forefoot areas and this base plate may have a matrix structure including: (a) a first plurality of rib elements 116A extending in a front-to-rear direction of the outsole component 104*a*, 204*a*, (b) a second plurality of rib elements 116B extending in a rear medial-to-forward lateral direction of the outsole component 104*a*, 204*a*, and (c) a third plurality of rib elements 116C extending in a forward medial-to-rear lateral direction of the outsole component 104*a*, 204*a*. The forefoot and/or midfoot areas further may include one or more three sided cleats (e.g., 130L1-L4, 130I1-I5, and 130M1-M5) extending from the base plate. At least one (and preferably more or even all) of these three sided cleats includes a cleat base 240, a cleat free end 242, a first side edge 244 extending between the cleat base 240 and the cleat free end 242, a second side edge 246A extending between the cleat base 240 and the cleat free end 242, and a third side edge 246B extending between the cleat base 240 and the cleat free end 242. At least some of these cleats may be oriented with respect to the matrix structure of the outsole component 104*a*, 204*a* so that, for individual cleats: (a) one of the second plurality of rib elements 116B aligns with a junction region 250A (e.g., a corner) between the first side edge 244 and the second side edge 246A, (b) one of the third plurality of rib elements 116C aligns with a junction region 250B between the first side edge 244 and the third side edge 246B, and (c) one of the first plurality of rib elements 116A aligns with a junction region 250C between the second side edge 246A and the third side edge 246B. See, for example, FIG. 2G. In addition to simply being aligned, if desired, the various rib elements 116A, 116B, and 116C may be integrally formed during the fabrication process to extend to and morph to form the respective junction areas 250C, 250A, and 250B (to provide a unitary, one-piece construction between the matrix structure and the cleats). This integral formation provides a lightweight, yet strong, stable, solid feeling cleat construction on the outsole component 104*a*, 204*a*.

In fact, if desired, an individual rib element 116A, 116B, and/or 116C of the matrix base structure may morph into and form a portion of more than one individual cleat element. For example, as shown in FIG. 2E, the matrix rib element labeled 272 aligns with and morphs into the forward junctions or edges of the two intermediate cleats labeled 274A and 274B.

Outsole components 104*a*, 204*a* (e.g., outsole plates) of the types described above (e.g., made from nylon 11 by an SLS process) can provide a sufficiently stiff and supportive forefoot area that can still flex and provide "spring-back" effect as the plate returns to its original shape during the non-contact time of a sprint step cycle (e.g., toe spring after toe off).

Also, outsole components 104*a* and 204*a* of the types described above made by an SLS or other rapid manufacturing additive fabrication technique may be further treated after the fabrication process. For example, at least some portions of the fabricated part may be wrapped, coated, impregnated, or exposed to an infiltrate or other material to alter a property of the part. This may be used, for example, to change the color of the part (or portions thereof), to add logos or graphics, to control hardness or flexibility, to control its water resistance or other absorbency properties, etc.

Articles of footwear and/or sole structures according to examples of this invention may have a wide variety of sizes, dimensions, shapes, etc. The following features may be provided in shoe/sole structures designed to improve and/or maximize sprinting speed on artificial or natural grass surfaces. For example, the matrix ribs 116A-116C may have a width dimension of less than 5 mm. At least some of the lateral and medial edge or perimeter cleats may have height dimension H up to about 20 mm (e.g., from 5 to 20 mm), with the cleats generally being a bit larger as one moves toward the rear of the shoe. The footbed thickness (e.g., the thickness within a recess of the matrix structure, not through a rib element) may be less than 2 mm, and in some examples, less than 1.5 mm or less than 1 mm. When placed on a horizontal surface S (e.g., as shown in FIG. 1F), the free end of the toe portion of the outsole component 104*a* (dimension $H_T$) may be at least 40 mm, and in some examples, at least 50 mm above the surface S. The raised toe of the shoe (in this orientation) helps promote a forward lean as the toes contact the ground during a sprinting effort. The heel fin 122 may have: (a) a height of at least about 60 mm (from the top to the bottom of edges 122M and 122L), and in some examples, at least about 70 mm; (b) a bottom width $W_F$ of about 30-40 mm; and (c) a top width (of top edge 122E) of 0 to 18 mm (and in some examples, 0-12 mm). The entire outsole component 104*a* (and optionally the entire shoe 100) may weigh less than 9 oz., and in some examples, less than 7 oz, or even less than 6 oz.

Also, while generally triangular shaped cleats are described in detail above, other cleat constructions are possible, including, for example, cleats having generally square, rectangular, parallelogram, and/or trapezoidal cross sectional shapes. Such cleats still may have one edge with a concave top-to-bottom exterior surface oriented to face the rear heel direction. Not all cleats on a single shoe and/or in a single forefoot area of a shoe need have the same overall sizes, shapes, and/or constructions.

III. Conclusion

The present invention is disclosed above and in the accompanying drawings with reference to a variety of embodiments and structural options. The purpose served by the disclosure, however, is to provide examples of the various features and concepts related to the invention, not to limit the scope of the invention. Those skilled in the art will understand that the structures, options, and/or alternatives for the cleat structures, sole structures, footwear structures, and/or methods described herein, including the features of the various different embodiments of the invention, may be used in any desired combinations, subcombinations, and the like, without departing from the invention. Those skilled in the relevant art also will recognize that numerous variations and modifications may be made to the embodiments described above without departing from the scope of the present invention, as defined by the appended claims.

What is claimed is:

1. A sole structure for an article of footwear, comprising:

an outsole component that includes:

a base plate, wherein the base plate has a matrix structure at least in a forefoot support area of the base plate, the matrix structure including: (i) a first plurality of rib elements extending in a front-to-rear direction of the outsole component, (ii) a second plurality of rib elements extending in a rear medial-to-forward lateral direction of the outsole component, and (iii) a third plurality of rib elements extending in a forward medial-to-rear lateral direction of the outsole component, a first lateral perimeter cleat extending from the base plate, integrally formed with rib elements of the matrix structure, and located along a lateral side of a forefoot area or a midfoot area of the outsole component, wherein the first lateral perimeter cleat includes a concave rear edge that faces a rear heel direction of the sole structure, a second lateral perimeter cleat extending from the base plate, integrally formed with rib elements of the matrix structure, and located along the lateral side of the outsole component and forward of the first lateral perimeter cleat, wherein the second lateral perimeter cleat includes a concave rear edge that faces the rear heel direction of the sole structure, a first medial perimeter cleat extending from the base plate, integrally formed with rib elements of the matrix structure, and located along a medial side of the forefoot area or the midfoot area of the outsole component, wherein the first medial perimeter cleat includes a concave rear edge that faces the rear heel direction of the sole structure, and a second medial perimeter cleat extending from the base plate, integrally formed with rib elements of the matrix structure, and located along the medial side of the outsole component and forward of the first medial perimeter cleat, wherein the second medial perimeter cleat includes a concave rear edge that faces the rear heel direction of the sole structure.

2. The sole structure according to claim 1, wherein the outsole component further includes:

a third lateral perimeter cleat extending from the base plate, integrally formed with rib elements of the matrix structure, and located along the lateral side of the outsole component and forward of the second lateral perimeter cleat, wherein the third lateral perimeter cleat includes a concave rear edge that faces the rear heel direction of the sole structure, and a third medial perimeter cleat extending from the base plate, integrally formed with rib elements of the matrix structure, and located along the medial side of the outsole component and forward of the second medial perimeter cleat, wherein the third medial perimeter cleat includes a concave rear edge that faces the rear heel direction of the sole structure.

3. The sole structure according to claim 2, wherein the outsole component further includes:

a first intermediate cleat extending from the base plate, integrally formed with rib elements of the matrix structure, and having at least a portion located between the first lateral perimeter cleat and the first medial perimeter cleat, wherein the first intermediate cleat includes a concave rear edge that faces the rear heel direction of the sole structure, a second intermediate cleat extending from the base plate, integrally formed with rib elements of the matrix structure, and having at least a portion located between the second lateral perimeter cleat and the second medial perimeter cleat, wherein the second intermediate cleat includes a concave rear edge that faces the rear heel direction of the sole structure, and a third intermediate cleat extending from the base plate, integrally formed with rib elements of the matrix structure, and having at least a portion located between the third lateral perimeter cleat and the third medial perimeter cleat, wherein the third intermediate cleat includes a concave rear edge that faces the rear heel direction of the sole structure.

4. The sole structure according to claim 3, wherein the first lateral perimeter cleat is located rearward from the first medial perimeter cleat, the second lateral perimeter cleat is located rearward from the second medial perimeter cleat, and the third lateral perimeter cleat is located rearward from the third medial perimeter cleat.

5. The sole structure according to claim 1, wherein the outsole component further includes a rear heel support extending upward from the base plate at a rear heel area of the outsole component, and wherein the rear heel support comprises a rear heel fin having a trapezoidal or triangular shape.

6. The sole structure according to claim 5, wherein the rear heel support includes a top edge or point, a first side edge extending downward from the top edge or point to a medial, bottom, rear heel area of the outsole component, and a second side edge extending downward from the top edge or point to a lateral, bottom, rear heel area of the outsole component, and wherein each of the first side edge and the second side edge includes a linear segment at least 2 inches long.

7. The sole structure according to claim 1, wherein the matrix structure includes at least one of: (a) a plurality of triangular shaped recesses located between adjacent portions of some of the first, second, and third pluralities of rib elements or (b) a plurality of triangular shaped openings extending through the outsole component and located between adjacent portions of some of the first, second, and third pluralities of rib elements.

8. The sole structure according to claim 1, wherein the matrix structure includes:

a first plurality of triangular shaped recesses located between adjacent portions of the first, second, and third pluralities of rib elements on a medial side of the outsole component, wherein the first plurality of triangular shaped recesses do not extend completely through the outsole component, a second plurality of triangular shaped recesses located between adjacent portions of the first, second, and third pluralities of rib elements on a lateral side of the outsole component, wherein the second plurality of triangular shaped recesses do not extend completely through the outsole component, and a plurality of triangular shaped openings extending completely through the outsole component, wherein the triangular shaped openings are located between adjacent portions of the first, second, and third pluralities of rib elements, and wherein the plurality of triangular shaped openings are located between the first plurality of triangular shaped recesses and the second plurality of triangular shaped recesses.

9. The sole structure according to claim 1, wherein the matrix structure extends from a lateral, rear heel area of the outsole component, through an arch area of the outsole component, and through a forefoot area of the outsole component.

10. The sole structure according to claim 1, wherein the outsole component further includes:

a first intermediate cleat extending from the base plate, integrally formed with rib elements of the matrix structure, and having at least a portion located between the first lateral perimeter cleat and the first medial perimeter cleat, wherein the first intermediate cleat includes a concave rear edge that faces the rear heel direction of the sole structure, and a second intermediate cleat extending from the base plate, integrally formed with rib elements of the matrix structure, and having at least a portion located between the second lateral perimeter cleat and the second medial perimeter cleat, wherein the second intermediate cleat includes a concave rear edge that faces the rear heel direction of the sole structure.

11. A sole structure for an article of footwear, comprising:

an outsole component including a base plate in a forefoot area of the outsole component, wherein the base plate has a matrix structure including:

(a) a first plurality of rib elements extending in a first direction, (b) a second plurality of rib elements extending in a second direction, and (c) a third plurality of rib elements extending in a third direction; and a three sided cleat extending from the base plate, wherein the three sided cleat includes:

(a) a cleat base, (b) a cleat free end, (c) a first side edge extending between the cleat base and the cleat free end, wherein the first side edge has a concave exterior surface over at least 50% of its height dimension between the cleat base and the cleat free end, (d) a second side edge extending between the cleat base and the cleat free end, and (e) a third side edge extending between the cleat base and the cleat free end, wherein one of the second plurality of rib elements aligns with a junction region between the first side edge and the second side edge, wherein one of the third plurality of rib elements aligns with a junction region between the first side edge and the third side edge, and wherein one of the first plurality of rib elements aligns with a junction region between the second side edge and the third side edge.

12. The sole structure according to claim 11, wherein the base plate and the three sided cleat are formed as a unitary, one-piece construction.

13. The sole structure according to claim 11, wherein the first direction is a front-to-rear direction of the outsole component, the second direction is a rear medial-to-forward lateral direction of the outsole component, and the third direction is a forward medial-to-rear lateral direction of the outsole component.

14. The sole structure according to claim 13, wherein the second side edge is flat or concave over at least 50% of its height dimension between the cleat base and the cleat free end, and wherein the third side edge is flat or concave over at least 50% of its height dimension between the cleat base and the cleat free end.

15. The sole structure according to claim 13, wherein the matrix structure includes at least one of: (a) a plurality of triangular shaped recesses located between adjacent portions of the first, second, and third pluralities of rib elements or (b) a plurality of triangular shaped openings extending through the outsole component and located between adjacent portions of the first, second, and third pluralities of rib elements.

16. The sole structure according to claim 13, wherein the matrix structure includes:

a plurality of triangular shaped recesses located between adjacent portions of the first, second, and third pluralities of rib elements, wherein the plurality of triangular shaped recesses do not extend completely through the outsole component, and a plurality of triangular shaped openings extending completely through the outsole component, wherein the triangular shaped openings are located between adjacent portions of the first, second, and third pluralities of rib elements, and wherein the plurality of triangular shaped openings are located on a medial side or a lateral side of the outsole component from the plurality of triangular shaped recesses.

17. The sole structure according to claim 13, wherein the matrix structure includes:

a first plurality of triangular shaped recesses located between adjacent portions of the first, second, and third pluralities of rib elements on a medial side of the outsole component, wherein the first plurality of triangular shaped recesses do not extend completely through the outsole component, a second plurality of triangular shaped recesses located between adjacent portions of the first, second, and third pluralities of rib elements on a lateral side of the outsole component, wherein the second plurality of triangular shaped recesses do not extend completely through the outsole component, and a plurality of triangular shaped openings extending completely through the outsole component, wherein the triangular shaped openings are located between adjacent portions of the first, second, and third pluralities of rib elements, and wherein the plurality of triangular shaped openings are located between the first plurality of triangular shaped recesses and the second plurality of triangular shaped recesses.

18. The sole structure according to claim 13, wherein the first side edge of the three sided cleat faces a rear heel area of the outsole component.

19. The sole structure according to claim 11, wherein:

(a) said one of the second plurality of rib elements that aligns with the junction region between the first side edge and the second side edge extends continuously to morph into and integrally form the junction region between the first side edge and the second side edge, (b) said one of the third plurality of rib elements that aligns with the junction region between the first side edge and the third side edge extends continuously to morph into and integrally form the junction region between the first side edge and the third side edge, and (c) said one of the first plurality of rib elements that aligns with the junction region between the second side edge and the third side edge extends continuously to morph into and integrally form the junction region between the second side edge and the third side edge.

20. The sole structure according to claim 11, wherein an opening is defined through the three sided cleat extending from the second side edge through to the third side edge.

* * * * *